US011849809B1

(12) United States Patent
Xiang

(10) Patent No.: US 11,849,809 B1
(45) Date of Patent: Dec. 26, 2023

(54) CORD TIGHTENING AND LOOSENING DEVICE, SHOE, GLOVE, MEDICAL PROTECTIVE EQUIPMENT AND STORAGE DEVICE

(71) Applicant: Feng Xiang, Shenzhen (CN)

(72) Inventor: Feng Xiang, Shenzhen (CN)

( * ) Notice: Subject to any disclaimer, the term of this patent is extended or adjusted under 35 U.S.C. 154(b) by 0 days.

(21) Appl. No.: 18/347,781

(22) Filed: Jul. 6, 2023

Related U.S. Application Data

(63) Continuation of application No. PCT/CN2023/101065, filed on Jun. 19, 2023.

(51) Int. Cl.

| | |
|---|---|
| ***A43C 1/00*** | (2006.01) |
| ***A43C 1/06*** | (2006.01) |
| ***A41F 1/06*** | (2006.01) |
| ***B65H 75/30*** | (2006.01) |

(52) U.S. Cl.
CPC ..... *A43C 1/06* (2013.01); *A41F 1/06* (2013.01); *B65H 75/30* (2013.01)

(58) Field of Classification Search
CPC ..... A43C 1/00; A43C 1/06; B65H 75/30
See application file for complete search history.

(56) References Cited

U.S. PATENT DOCUMENTS

| | | | | |
|---|---|---|---|---|
| 10,368,613 | B2 * | 8/2019 | Ha | A43C 7/00 |
| 10,842,230 | B2 * | 11/2020 | Pollack | F16G 11/12 |
| 2015/0313319 | A1 * | 11/2015 | Ha | A43C 11/165 24/712 |
| 2020/0345107 | A1 * | 11/2020 | Burt | A43C 17/02 |
| 2020/0346888 | A1 * | 11/2020 | Kruse | A43B 23/0205 |

* cited by examiner

*Primary Examiner* — Sang K Kim
(74) *Attorney, Agent, or Firm* — Daniel M. Cohn; Howard M. Cohn

(57) ABSTRACT

The present disclosure discloses a cord tightening and loosening device, a shoe, a glove, a medical protective equipment and a storage device. The cord tightening and loosening device includes a rotary knob, a pawl disc, a base, a reel and a chassis. When the first meshing part is meshed with the second meshing part and the rotary knob rotates in a first clock direction, the rotary knob can drive the pawl disc to rotate, and then the pawl disc drives the reel to rotate, so that the cord tightening and loosening device can be in a tightening state and the cord can be wound around the winding part to tighten the cord.

15 Claims, 24 Drawing Sheets

CORD TIGHTENING AND LOOSENING DEVICE, SHOE, GLOVE, MEDICAL PROTECTIVE EQUIPMENT AND STORAGE DEVICE

CROSS-REFERENCE TO RELATED APPLICATIONS

This application is a continuation of International Application No. PCT/CN2023/101065, filed on Jun. 19, 2023, which is incorporated herein by reference in its entireties.

TECHNICAL FIELD

The present disclosure relates to a cord tightening and loosening device, a shoe, a glove, a medical protective equipment and a storage device.

BACKGROUND

In order to make some articles for daily use suitable for different users, many articles for daily use, such as gym shoes, caps, sport shirts and gloves, are designed with draw cords, and the tightness of the articles can be adjusted by knotting the draw cords. However, in daily life, the knotted draw cords are sometimes easy to loosen and fall off. For example, the shoelaces are easy to get dirty and trip over a user, especially for young children who cannot tie cords by oneself. It is very inconvenient for the elderly to bend over to tie cords because of poor health, which is easy to cause danger.

SUMMARY

To solve the above-mentioned problems, the present disclosure discloses a cord tightening and loosening device, a shoe, a glove, a medical protective equipment and a storage device.

The cord tightening and loosening device, including:

a rotary knob, including a cover plate, a first clamping part formed on one side of the cover plate, a driving member formed on one side of the cover plate, a side plate connected to one side of the cover plate, and a first limiting member connected to the end, away from the cover plate, of the side plate;

a pawl disc, including a base plate, a second clamping part formed on the side, adjacent to the first clamping part, of the base plate and used for being clamped with the first clamping part, a first check member formed on an outer edge of the base plate, a first meshing part formed between the base plate and the first check member, and a connecting part connected to the first meshing part;

a base, including a side wall structure annularly arranged on the circumference of the pawl disc, a second check member formed on an inner surface of the side wall structure, and a second limiting member formed on the side wall structure; the side wall structure accommodates the pawl disc, a first cord inlet hole is also formed in the side wall structure in a penetrating manner, and the second check member is meshed with the first check member, so that the pawl disc can rotate relative to the base along a predetermined clock direction; the second limiting member extends into a storage space surrounded by the cover plate and the side plate, and can be limited in the storage space by the first limiting member; the rotary knob can drive the pawl disc to rotate;

a reel, located in the side wall structure and arranged on the side, away from the rotary knob, the pawl disc, and including two opposite base plate parts, a winding part connected between the two base plate parts, an extended wall connected to the base plate close to the pawl disc, and a second meshing part arranged on the inner side of the extended wall and used for being matched with the first meshing part; the winding part includes a second cord inlet hole, so that a cord can pass through the first cord inlet hole and the second cord inlet hole and is arranged on the reel;

a chassis, located on the side, away from the rotary knob, of the base and fixed with the base;

wherein, when the first meshing part is meshed with the second meshing part and the rotary knob rotates in a first clock direction, the rotary knob can drive the pawl disc to rotate, and then the pawl disc drives the reel to rotate, so that the cord tightening and loosening device can be in a tightening state and the cord can be wound around the winding part to tighten the cord;

when the rotary knob rotates in a second clock direction opposite to the first clock direction, the driving member drives the connecting part, the first meshing part is separated from the second meshing part, the cord tightening and loosening device is in a loosening state, and then the reel can rotate to realize the release of the cord.

Compared with the prior art, in the cord tightening and loosening device of the present disclosure, when the first meshing part of the pawl disc is meshed with the second meshing part of the reel and the rotary knob rotates in a first clock direction, the rotary knob can drive the pawl disc to rotate, and then the pawl disc drives the reel to rotate, so that the cord tightening and loosening device can be in a tightening state and the cord can be wound around the winding part of the reel to tighten the cord. When the rotary knob rotates in a second clock direction opposite to the first clock direction, the driving member of the rotary knob drives the connecting part of the pawl disc, the first meshing part of the pawl disc is separated from the second meshing part of the reel, the cord tightening and loosening device is in a loosening state, and then the reel can rotate to realize the release of the cord. The cord tightening and loosening device can tighten the cord through forward rotation and loosen the cord through reverse rotation, and is simple in operation and high in user experience. In addition, the number of whole components of the cord tightening and loosening device is small, thus reducing the assembly cost and improving the assembly efficiency. The whole structure is compact, thus facilitating the miniaturization and lightweight of the cord tightening and loosening device. Moreover, the small number of the components can also improve the stability of the whole structure, so that the reliability of the cord tightening and loosening device is improved, and the service life of the cord tightening and loosening device is prolonged.

In one embodiment, the rotary knob also includes a top block arranged on one side of the cover plate, and the top block is used for abutting between the inner side of the first check member and the winding part in the loosening state to prevent the first check member from being separated from the second check member.

It can be understood that the top block can prevent the first check member from being separated from the second check member in the loosening state, thus facilitating switching from the loosening state to the tightening state and improving the reliability of the cord tightening and tightening device.

In one embodiment, the top block includes an inner side surface and an outer side surface, and the distance between the inner side surface and the outer side surface is gradually decreased along the first clock direction. Through the top block, it is convenient for the top block to gradually increase the abutting force, thus effectively abutting against and preventing the first check member from being separated from the second check member.

In one embodiment, the connecting part includes a cylinder, and a side surface of the driving member is used for abutting against an outer circumferential surface of the cylinder to drive the connecting part. It can be understood that the connecting part is a cylinder and the side surface of the driving member is used for abutting against the outer circumferential surface of the cylinder, so that the driving member can smoothly drive the connecting part, and the switching of the cord tightening and loosening device from the tightening state to the loosening state is successfully completed.

In one embodiment, the connecting part also includes an extended block connected with the cylinder, and the extended block is used for abutting against the top block in the loosening state; the driving member includes a driving main body part and a stop part connected to the driving main body part, and a side surface of the driving main body part is used for abutting against an outer circumferential surface of the top block to drive the connecting part; the stop part is bent and connected with the driving main body part, and is used for stopping the top block after the connecting part is driven, so as to prevent the first meshing part from sliding out to the outer side of the driving part, thus causing the phenomenon that the loosening state cannot be realized.

In one embodiment, the first clamping part includes an anti-forward rotation clamping part and an anti-reverse rotation clamping part; when the cord tightening and loosening device is in the tightening state, the anti-reverse rotation clamping part is clamped with the second clamping part; and when the cord tightening and loosening device is in the loosening state, the anti-forward rotation clamping part is clamped with the second clamping part. Through the anti-forward rotation clamping part and the anti-reverse rotation clamping part, a rotation phenomenon caused by accidental contact or automatic rebound can be effectively prevented, and the reliability of the cord tightening and loosening device can be improved.

In one embodiment, the number of the second clamping parts is at least two, the second clamping parts are distributed in turn along the circumferential direction, the numbers of the anti-forward rotation clamping parts and the anti-reverse rotation clamping parts are both at least two, and the anti-forward rotation clamping parts and the anti-reverse rotation clamping parts are distributed in turn along the circumferential direction; the numbers of the first clamping parts and the connecting parts are both at least two, and the first clamping parts and the connecting parts are distributed in turn along the circumferential direction; the numbers of the first check members and the second check members are at least two, and the first check members and the second check members are distributed in turn along the circumferential direction; the numbers of the driving members and the top blocks are consistent with and corresponding to the number of the connecting parts; the first check member includes an elastic arm and a first check tooth connected with the elastic arm, and the second check member includes a plurality of second check teeth connected in turn along the circumferential direction; the first meshing part includes a connecting arm and a first meshing tooth connected to the connecting arm, and the second meshing part includes a plurality of second meshing teeth connected in turn along the circumferential direction. It can be understood that the technical effect of improving the stability and reliability of the cord tightening and loosening device can be achieved through the arrangement of the second clamping parts, the anti-forward rotation clamping parts, the anti-reverse rotation clamping parts, the first meshing parts, the connecting parts, the first check members, the second check members, the driving members, the top blocks, the second check teeth and the second meshing teeth.

In one embodiment, the rotary knob includes a raised structure arranged in a middle area of the cover plate, the anti-forward rotation clamping part and the anti-reverse rotation clamping part are grooves formed in an outer side surface of the raised structure in turn, the base plate includes a groove structure formed in a middle area, the second clamping part includes a hook extending into the groove structure, and the hook is used for being clamped with the groove of the anti-forward rotation clamping part or the groove of the anti-reverse rotation clamping part. Since the hook and the groove structure are simple and high in reliability, through the cooperation between the hook and the groove, a rotation phenomenon caused by accidental contact or automatic rebound can be effectively prevented, and the reliability of the cord tightening and loosening device is improved.

In one embodiment, the outer side surface of the raised structure is also provided with a first limiting part, a side wall surface of the groove structure is also provided with a second limiting part, one of the first limiting part and the second limiting part is a limiting block, the other of the first limiting part and the second limiting part is a limiting chute, and the limiting block is used for sliding in the limiting chute to limit a relative rotation angle of the rotary knob and the pawl disc, so that the anti-forward rotation clamping part and the anti-reverse rotation clamping part of the rotary knob are meshed with or separated from the second clamping part of the pawl disc in turn. It can be understood that due to simple structure and high reliability of the limiting block and the limiting chute, the relative rotation angle between the rotary knob and the pawl disc can be limited through the cooperation between the limiting block and the limiting chute, and the anti-forward rotation clamping part and the anti-reverse rotation clamping part of the rotary knob can be meshed with or separated from the second clamping part of the pawl disc in turn, so that the stability and user experience of the cord tightening and loosening device are improved.

In one embodiment, the groove includes a first surface and a second surface which are bent and connected, the raised structure is provided with an arc surface connected to the first surface and the second surface, the angle between the first surface and the tangent line of a connection point of the arc surface of the part where the first surface is connected and is different from the angle between the second surface and the tangent line of a connection point of the arc surface of the part where the second surface is connected, so that the external force required for separating the hook from the groove of the anti-forward rotation clamping part is less than the external force required for separating the hook from the groove of the anti-reverse rotation clamping part. It can be understood that through the arrangement of the above structure, the external force required for separating the hook from the groove of the anti-forward rotation clamping part can be less than the external force required for separating the hook from the groove of the anti-reverse rotation clamping part, so that the user experience is improved.

In one embodiment, the anti-forward rotation clamping part and the anti-reverse rotation clamping part are grooves formed in the cover plate in turn along the circumferential direction, the second clamping part is a clamping block arranged on the winding part, and the clamping block is used for being clamped with the groove of the anti-forward rotation clamping part or the groove of the anti-reverse rotation clamping part. Since the clamping block and the groove structure are simple and high in reliability, through the cooperation between the clamping block and the groove, a rotation phenomenon caused by accidental contact or automatic rebound can be effectively prevented, and the reliability of the cord tightening and loosening device is improved.

In one embodiment, one side of the cover plate is also provided with a first limiting part, the side, close to the cover plate, of the winding part is also provided with a second limiting part, one of the first limiting part and the second limiting part is a limiting block, the other of the first limiting part and the second limiting part is a limiting chute, and the limiting block is used for sliding in the limiting chute to limit a relative rotation angle between the rotary knob and the pawl disc, so that the anti-forward rotation clamping part and the anti-reverse rotation clamping part of the rotary knob are meshed with or separated from the second clamping part of the pawl disc in turn; the numbers of the first limiting parts and the second limiting parts are at least two, the first limiting parts and the second limiting parts are distributed along the circumferential direction. It can be understood that due to simple structure and high reliability of the limiting block and the limiting chute, the relative rotation angle between the rotary knob and the pawl disc can be limited through the cooperation between the limiting block and the limiting chute, and the anti-forward rotation clamping part and the anti-reverse rotation clamping part of the rotary knob can be meshed with or separated from the second clamping part of the pawl disc in turn, so that the stability and user experience of the cord tightening and loosening device are improved.

In one embodiment, the height of an axis of the clamping block along the direction from the rotary knob to the pawl disc is less than the height of the limiting block along the height of the axis, which can ensure that the rotary knob and the pawl disc are still kept connected and restricted at relative positions when the clamping block is meshed and switched with the different grooves, thus preventing over rotation of the rotary knob.

In one embodiment, the groove includes a first surface and a second surface which are bent and connected, and the angle between a body surface on one side of the cover plate and the first surface is different from the angle between the body surface on one side of the cover plate and the second surface, so that the external force required for separating the clamping block from the groove of the anti-forward rotation clamping part is less than the external force required for separating the clamping block from the groove of the anti-reverse rotation clamping part. It can be understood that through the arrangement of the above structure, the external force required for separating the clamping block from the groove of the anti-forward rotation clamping part can be less than the external force required for separating the clamping block from the groove of the anti-reverse rotation clamping part, so that the user experience is improved.

In one embodiment, the base plate part away from the pawl disc also includes at least one slot communicating with the second cord inlet hole, and the slot is used for accommodating a knot for limiting the cord. Through the arrangement of the slot, the knot of the cord thread is accommodated, the knot can be limited, and the phenomena such as knot jamming and breaking away from the reel can be effectively avoided.

An embodiment of the present disclosure also provides a shoe. The shoe includes a shoe body, a shoelace and the cord tightening and loosening device in any of the above embodiments. The shoelace serves as a cord. The cord tightening and loosening device is used for tightening and loosening the shoelace.

An embodiment of the present disclosure also provides a cap. The cap includes a cap body, a cap cord and the cord tightening and loosening device in any of the above embodiments. The cap cord is used for tightening or loosening the cap body. The cap cord serves as a cord. The cord tightening and loosening device is used for tightening and loosening the cap cord.

An embodiment of the present disclosure also provides a glove, The glove includes a glove body, a glove cord, and the cord tightening and loosening device in any of the above embodiments. The glove cord is used for tightening or loosening the glove body. The glove cord serves as the cord. The cord tightening and loosening device is used for tightening and loosening the glove cord.

An embodiment of the present disclosure also provides a medical protective equipment. The medical protective equipment includes a medical protective equipment body, a medical protective equipment cord, and the cord tightening and loosening device in any of the above embodiments. The medical protective equipment is used for tightening or loosening an opening of the medical protective equipment body. The medical protective equipment cord serves as the cord. The cord tightening and loosening device is used for tightening and loosening the medical protective equipment cord.

An embodiment of the present disclosure also provides a storage device. The storage device includes a storage body, a storage cord and the cord tightening and loosening device in any of the above embodiments. The storage cord is used for tightening or loosening the storage body. The storage cord serves as a cord. The cord tightening and loosening device is used for tightening and loosening the storage cord.

It can be understood that among the shoe, hat, glove, a medical protective equipment, and storage device provided in the above embodiments, due to the presence of the cord tightening and loosening device described in any of the above embodiments, as well as the technical effects of the cord tightening and loosening device described in detail above, it will not be repeated here.

BRIEF DESCRIPTION OF THE DRAWINGS

The technical solutions in the embodiments of the present disclosure will be clearly and completely described below in conjunction with the accompanying drawings in the embodiments of the present disclosure. Apparently, the described embodiments are only a part of the embodiments of the present disclosure, rather than all the embodiments. Based on the embodiments in the present disclosure, all other embodiments obtained by those ordinarily skilled in the art without doing creative work shall fall within the protection scope of the present disclosure.

In order to make the aims, technical solution and advantages of the present disclosure will be clearly, the present disclosure is further described below in combination with accompanying drawings and implementations.

It should be understood that although the terms first, second, third, etc. may be used to describe various kinds of information in the present disclosure, this information should not be limited to these terms. These terms are only used to distinguish the same type of information from each other.

Figure 1:
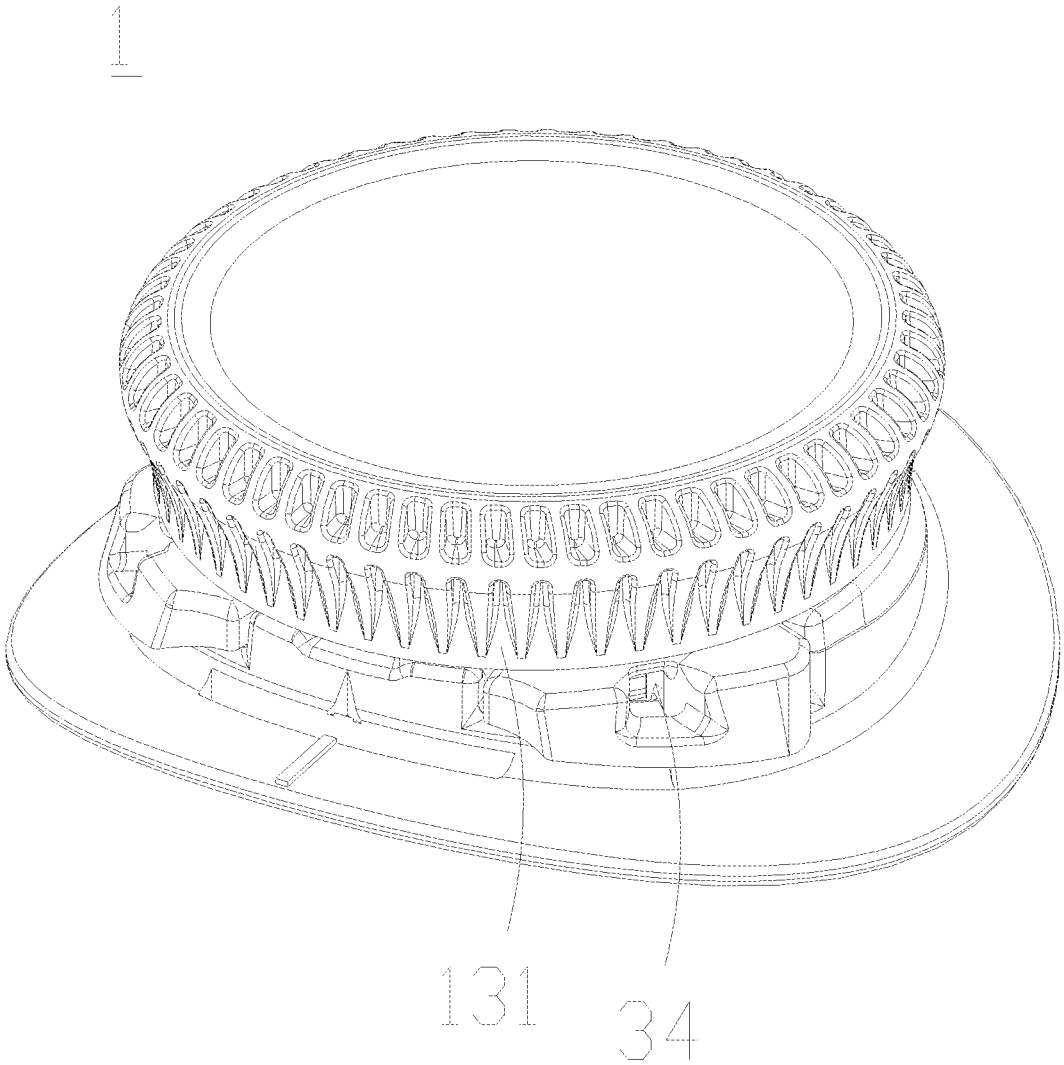

FIG. 1 is a space diagram of a cord tightening and loosening device in a first embodiment of the present disclosure.

Figure 2:
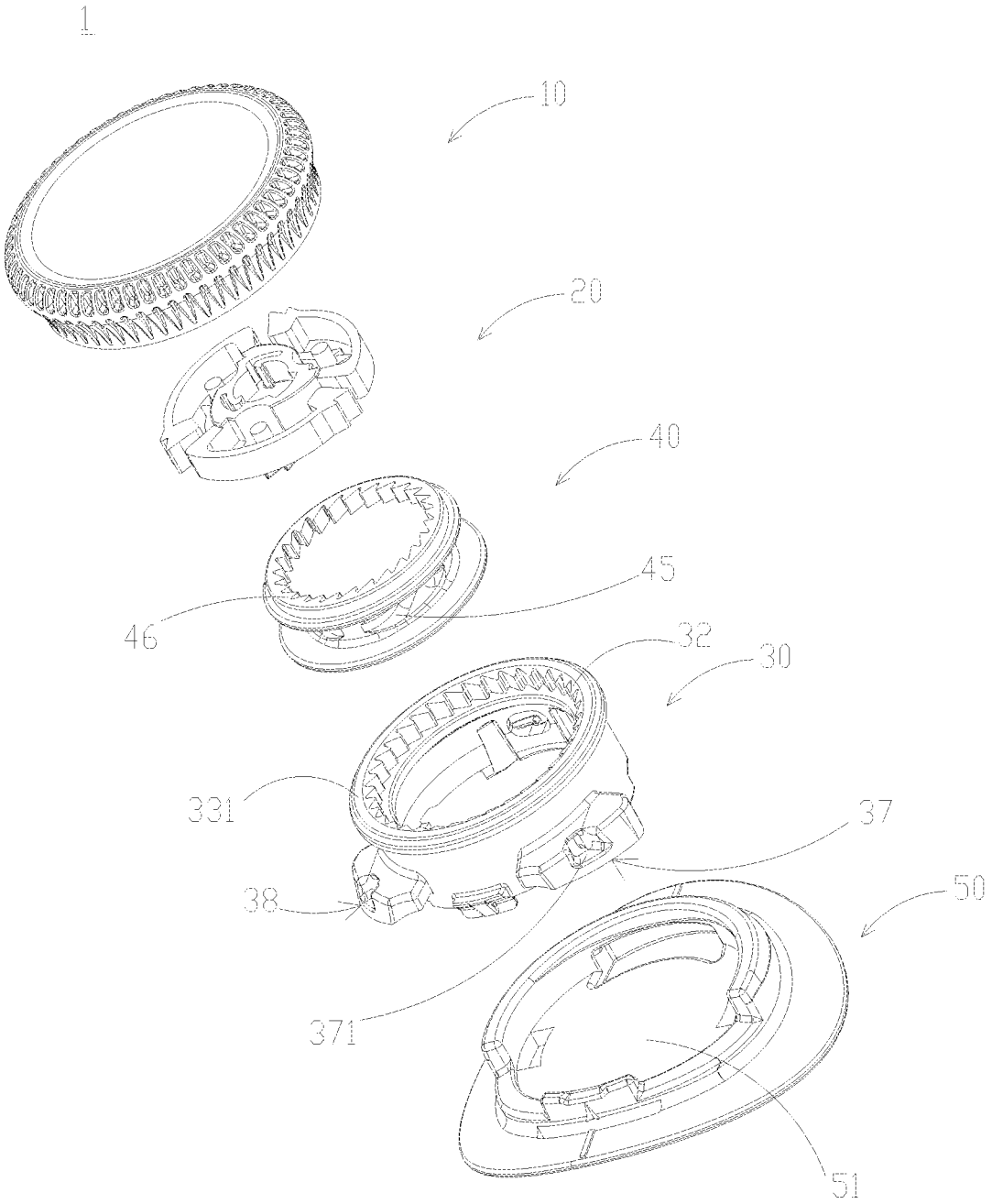

FIG. 2 is an explosive view of the cord tightening and loosening device as shown in FIG. 1.

Figure 3:
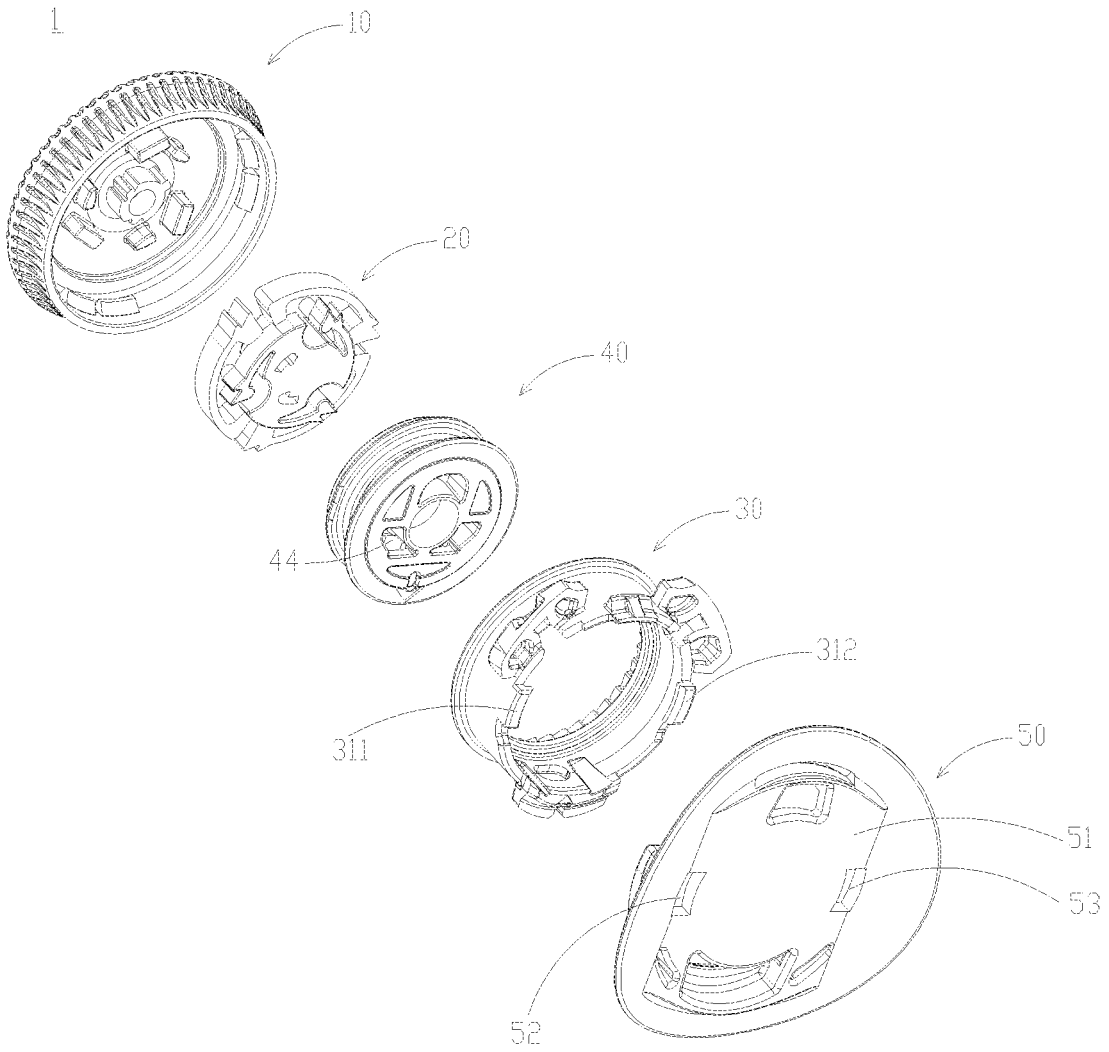

FIG. 3 is an explosive view of the cord tightening and loosening device as shown in FIG. 1 in another perspective.

Figure 4:
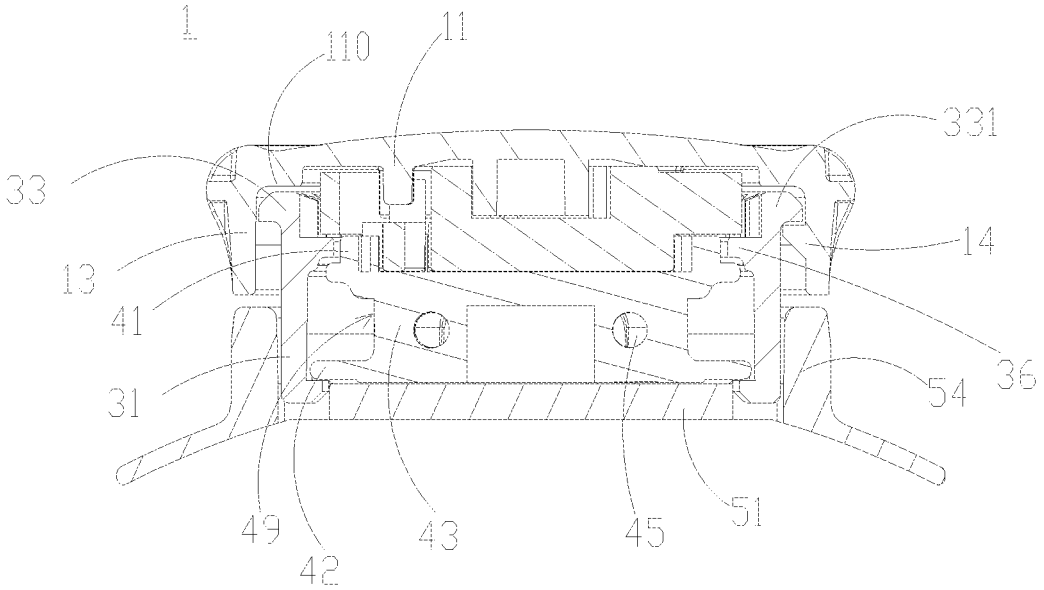

FIG. 4 is a profile view of the cord tightening and loosening device as shown in FIG. 1.

Figure 5:
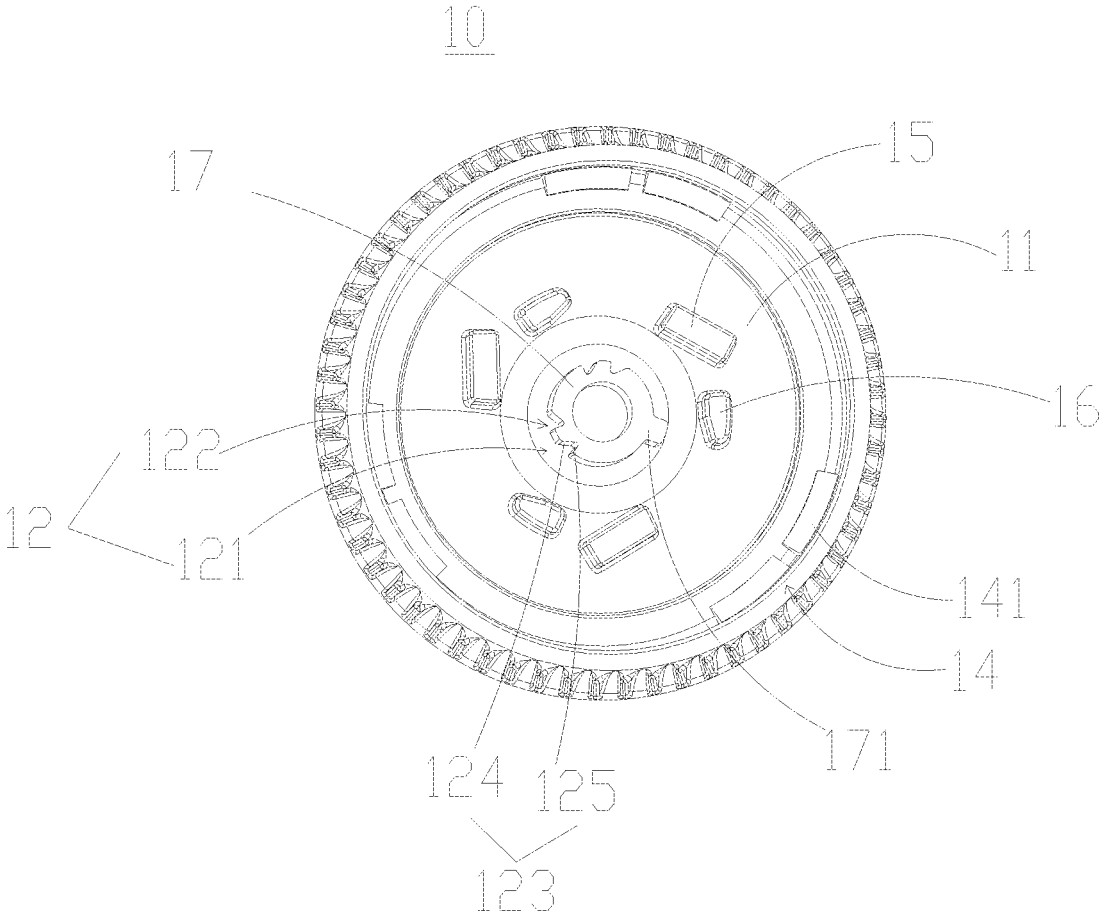

FIG. 5 is a space diagram of a rotary knob of the cord tightening and loosening device as shown in FIG. 2.

Figure 6:
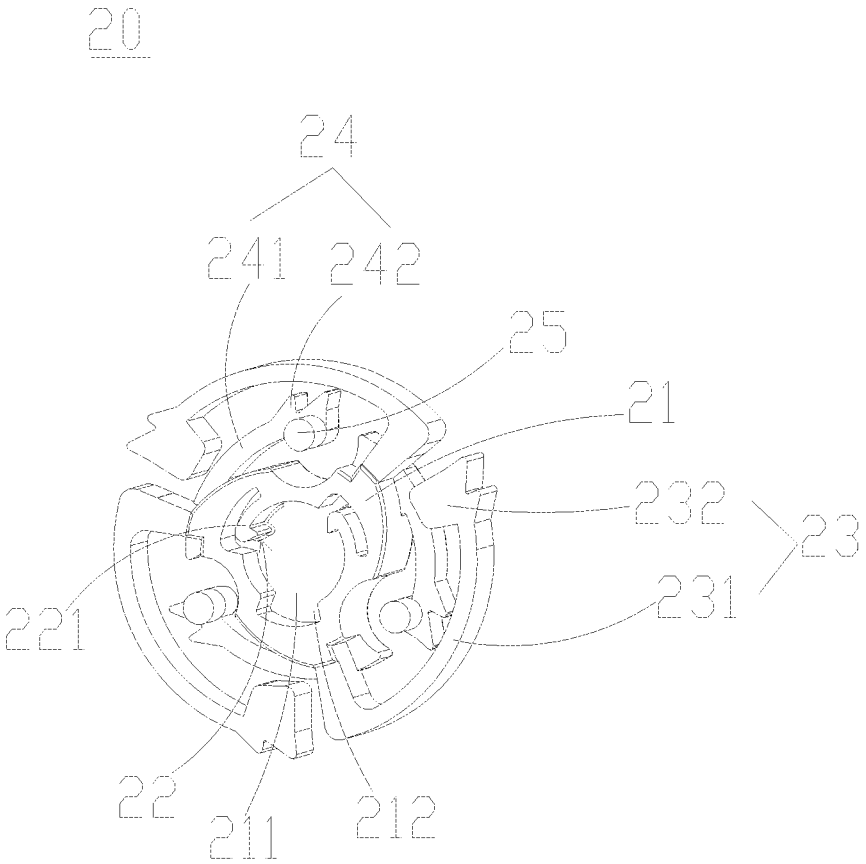

FIG. 6 is a space diagram of a pawl disc of the cord tightening and loosening device as shown in FIG. 3.

Figure 7:
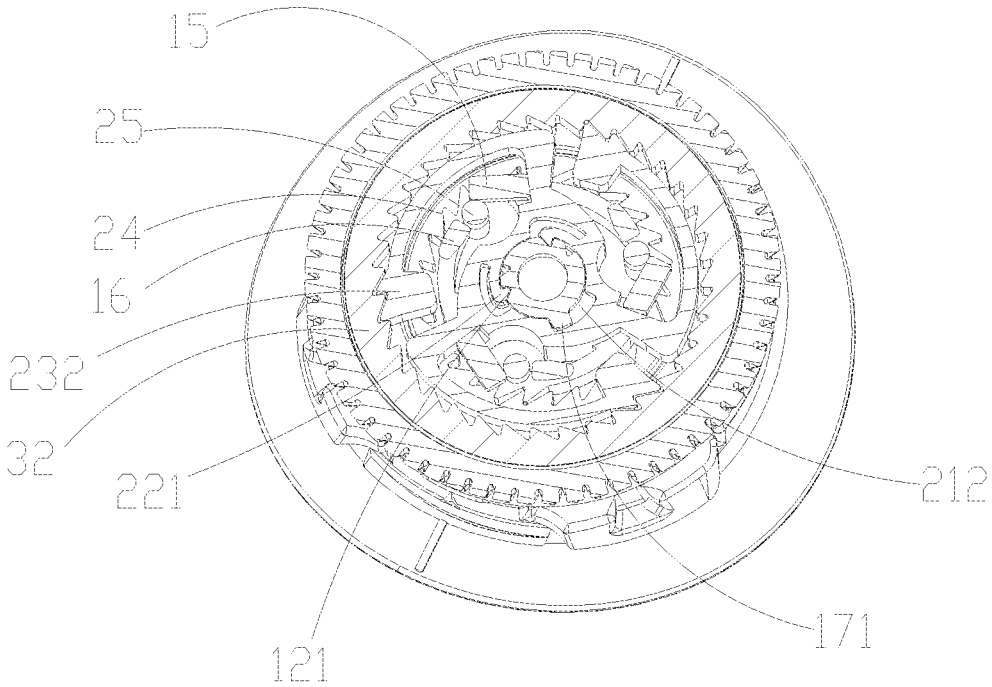

FIG. 7 is a section view of the cord tightening and loosening device as shown in FIG. 1 in a tightening state.

Figure 8:
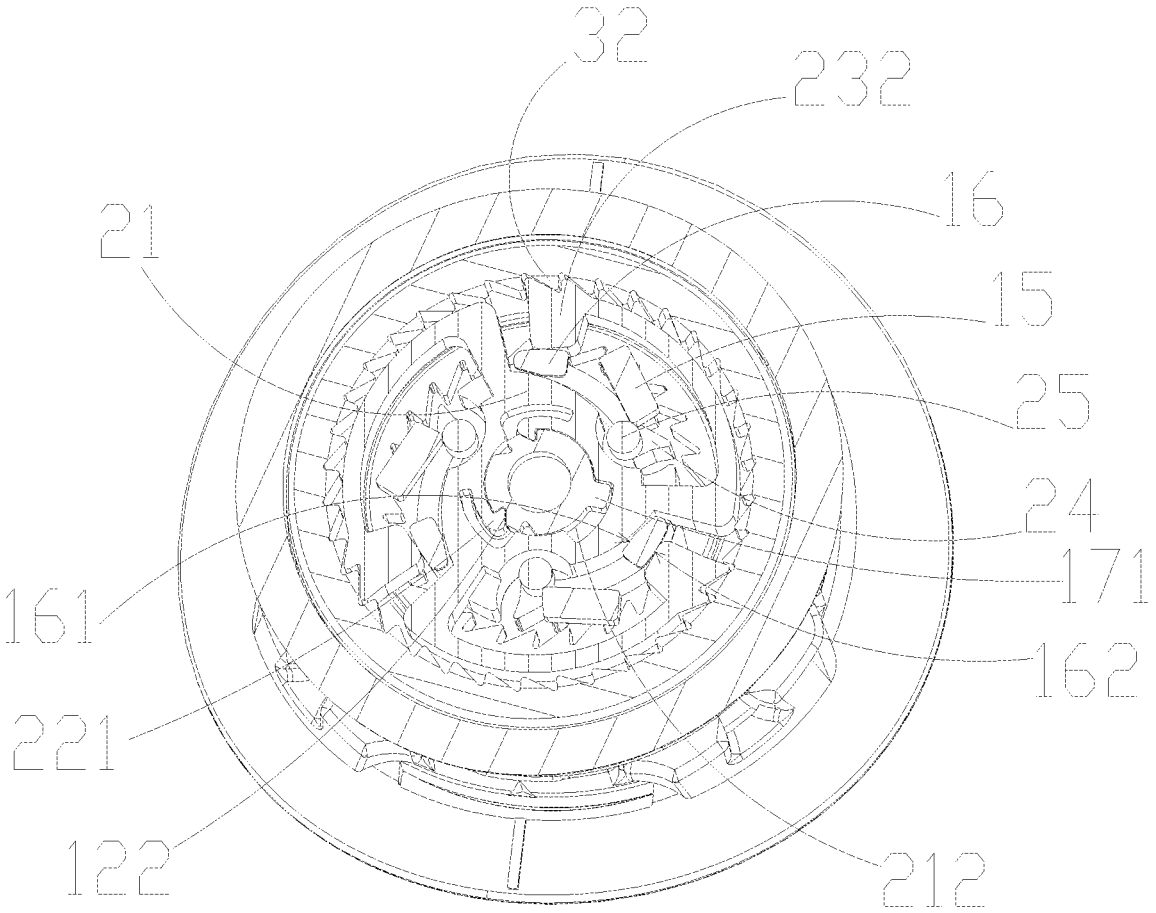

FIG. 8 is a section view of the cord tightening and loosening device as shown in FIG. 1 in a loosening state.

Figure 9:
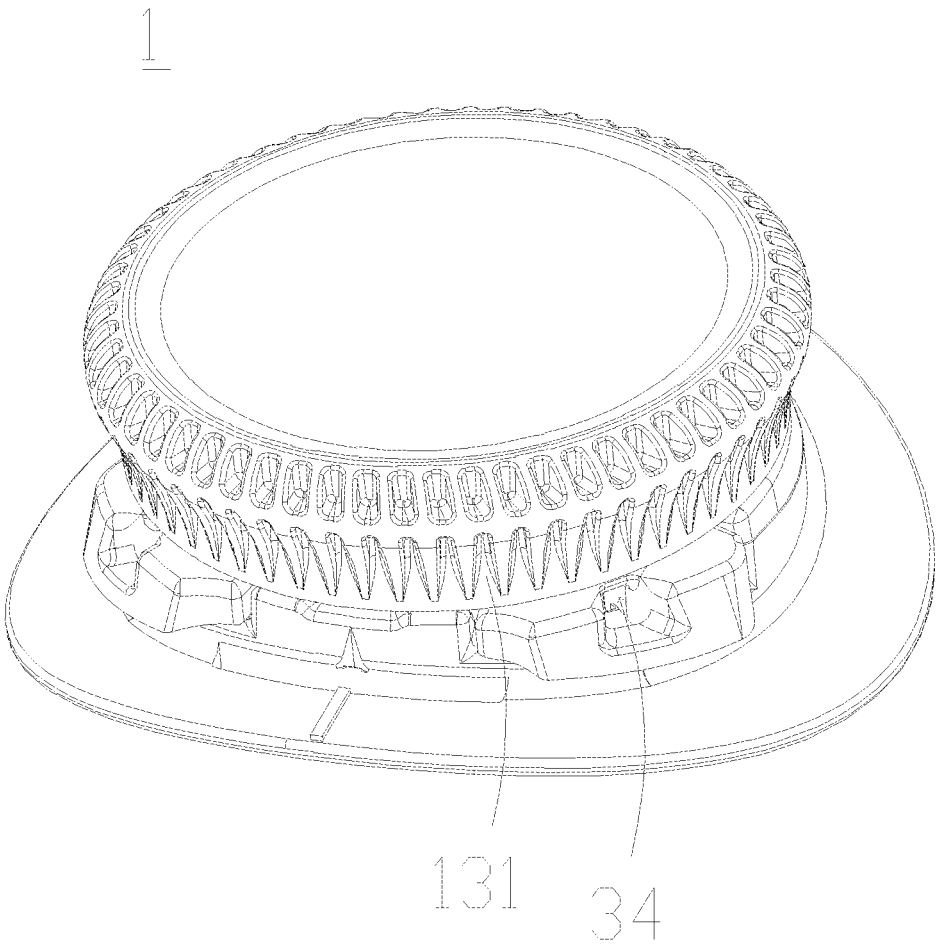

FIG. 9 is a space diagram of the cord tightening and loosening device in a second embodiment of the present disclosure.

Figure 10:
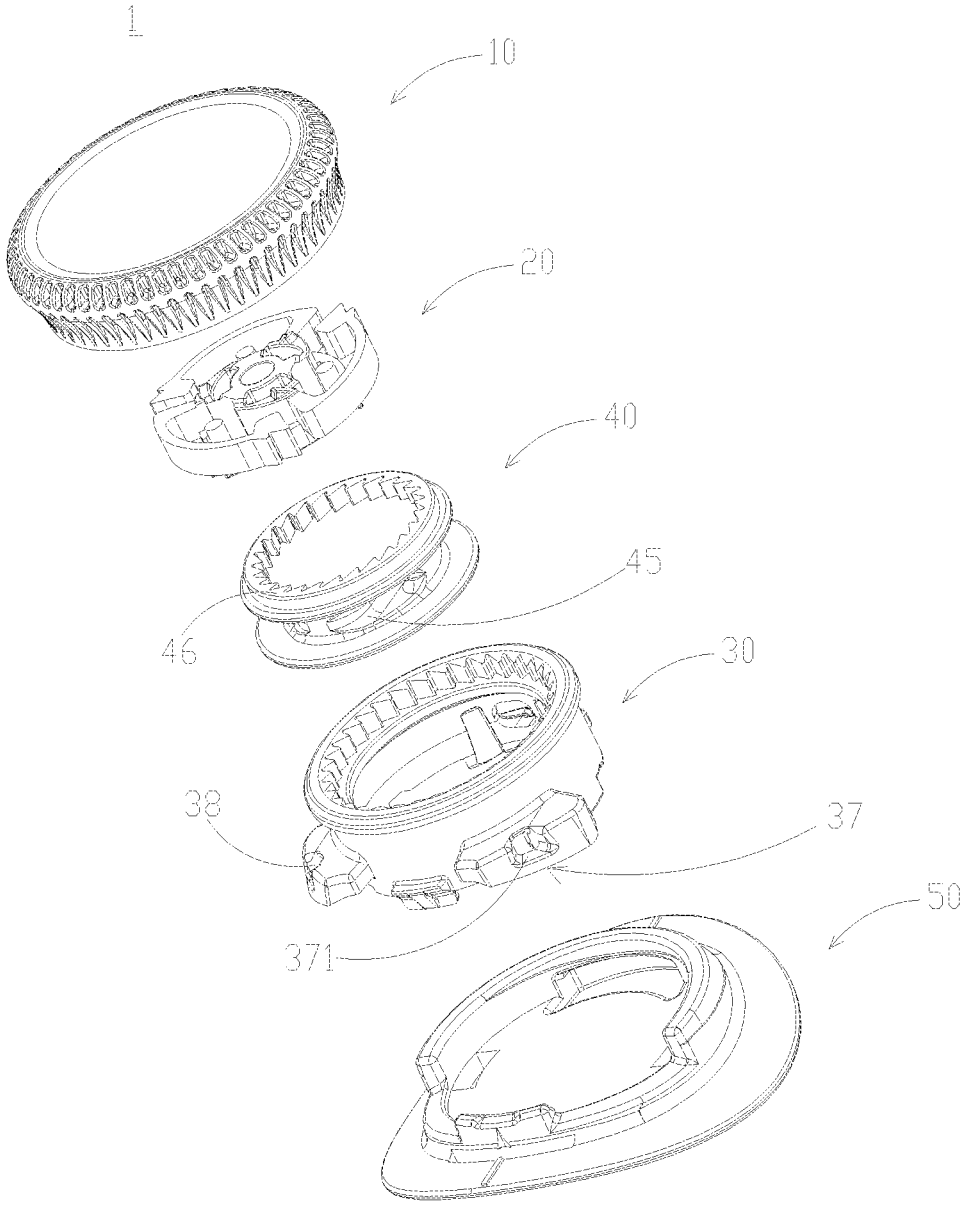

FIG. 10 is an explosive view of the cord tightening and loosening device as shown in FIG. 9.

Figure 11:
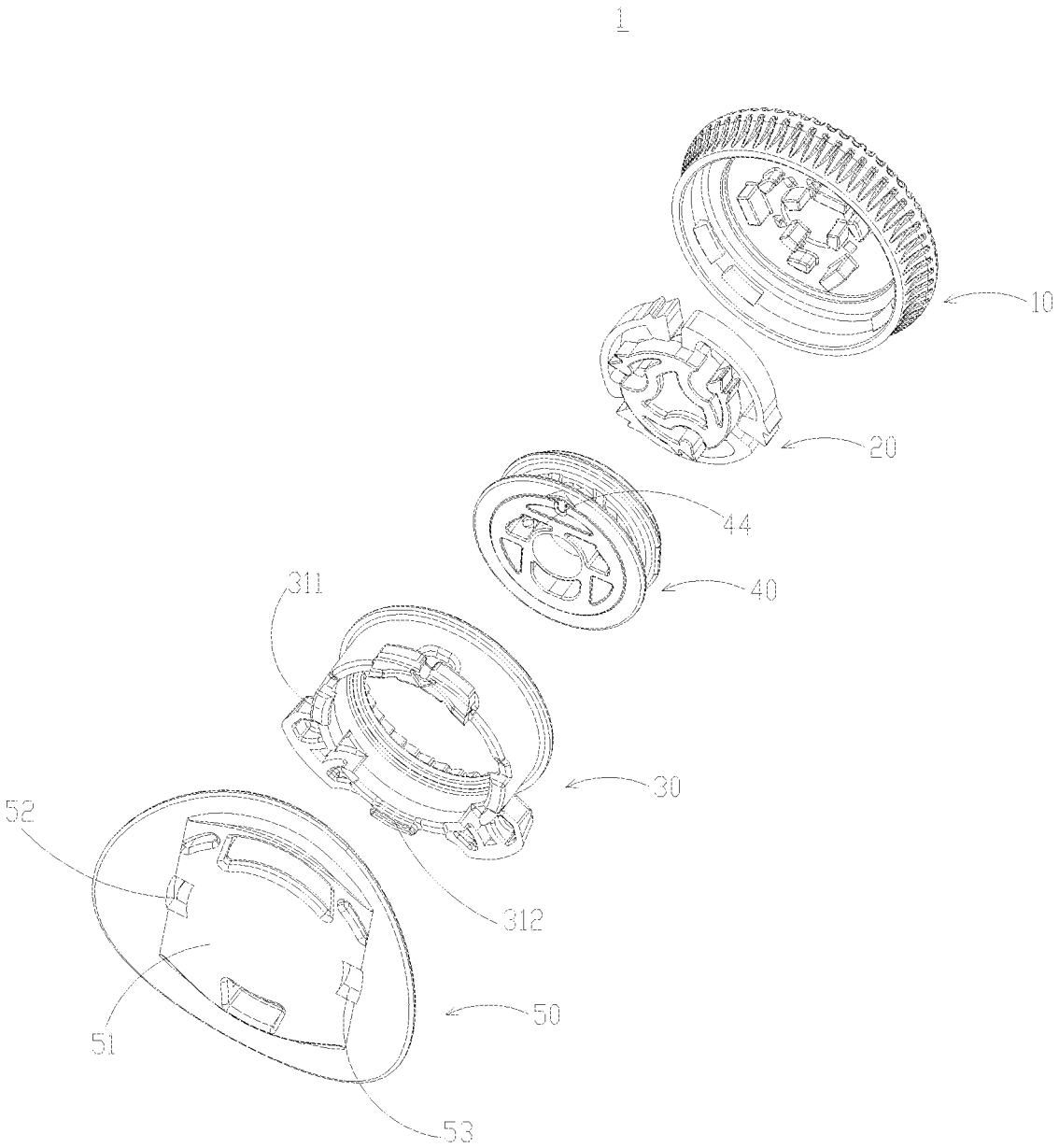

FIG. 11 is an explosive view of the cord tightening and loosening device as shown in FIG. 9 in another perspective.

Figure 12:
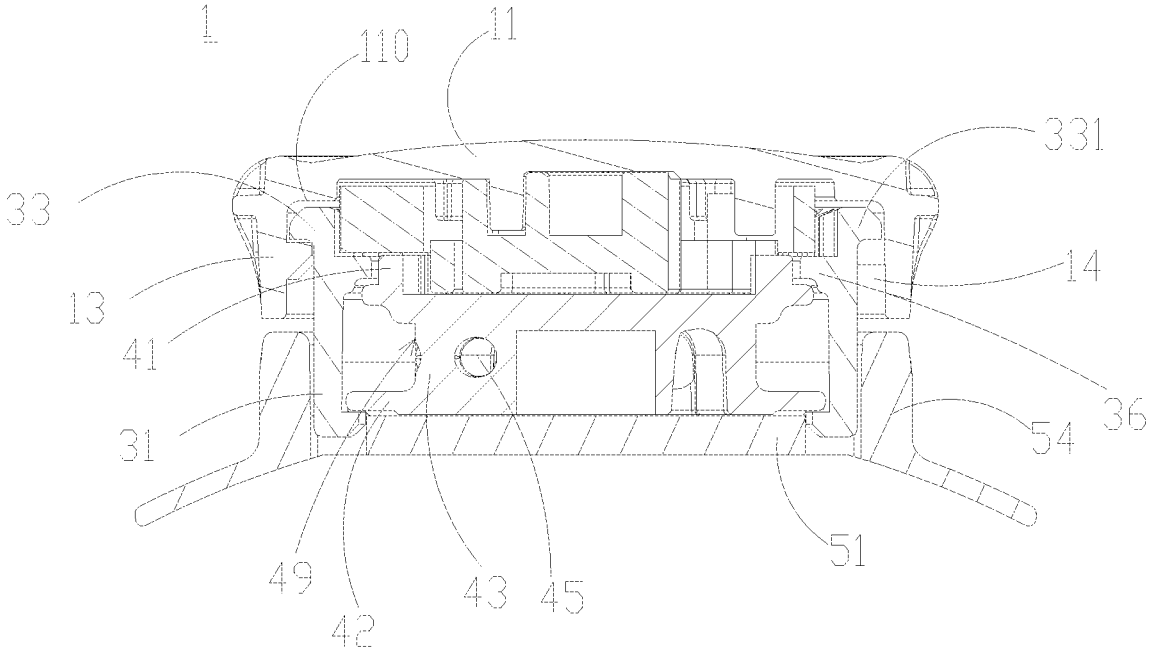

FIG. 12 is a profile view of the cord tightening and loosening device as shown in FIG. 9.

Figure 13:
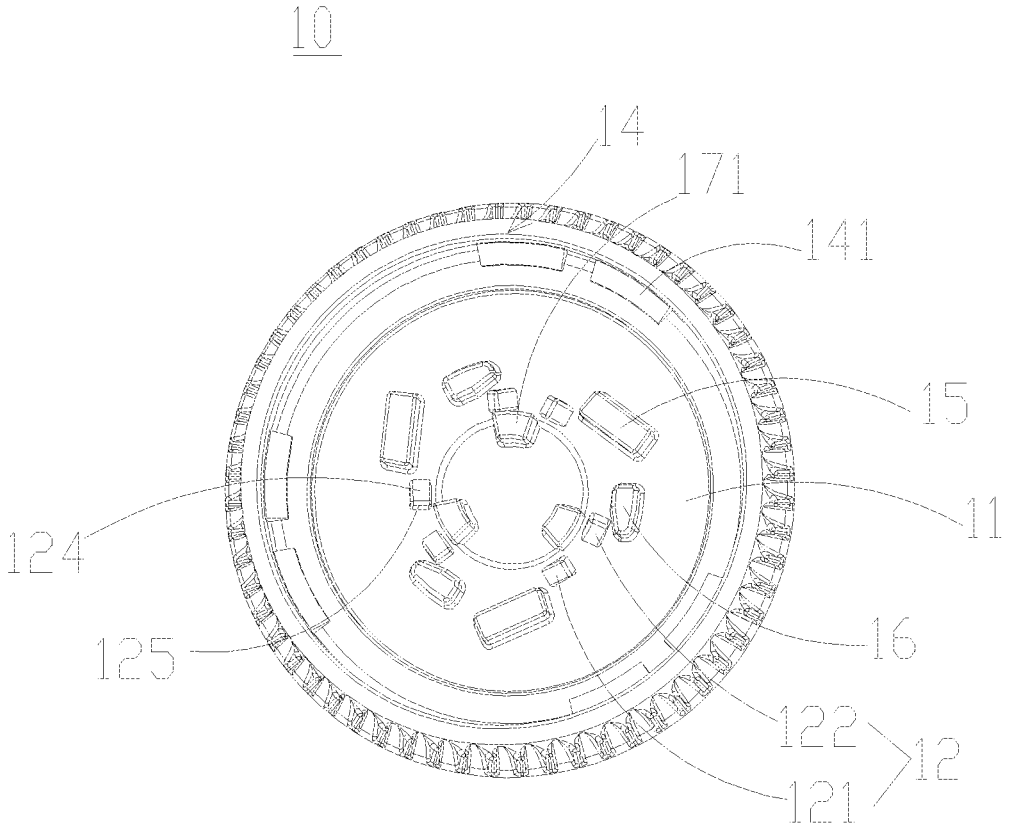

FIG. 13 is a space diagram of a rotary knob of the cord tightening and loosening device as shown in FIG. 10.

Figure 14:
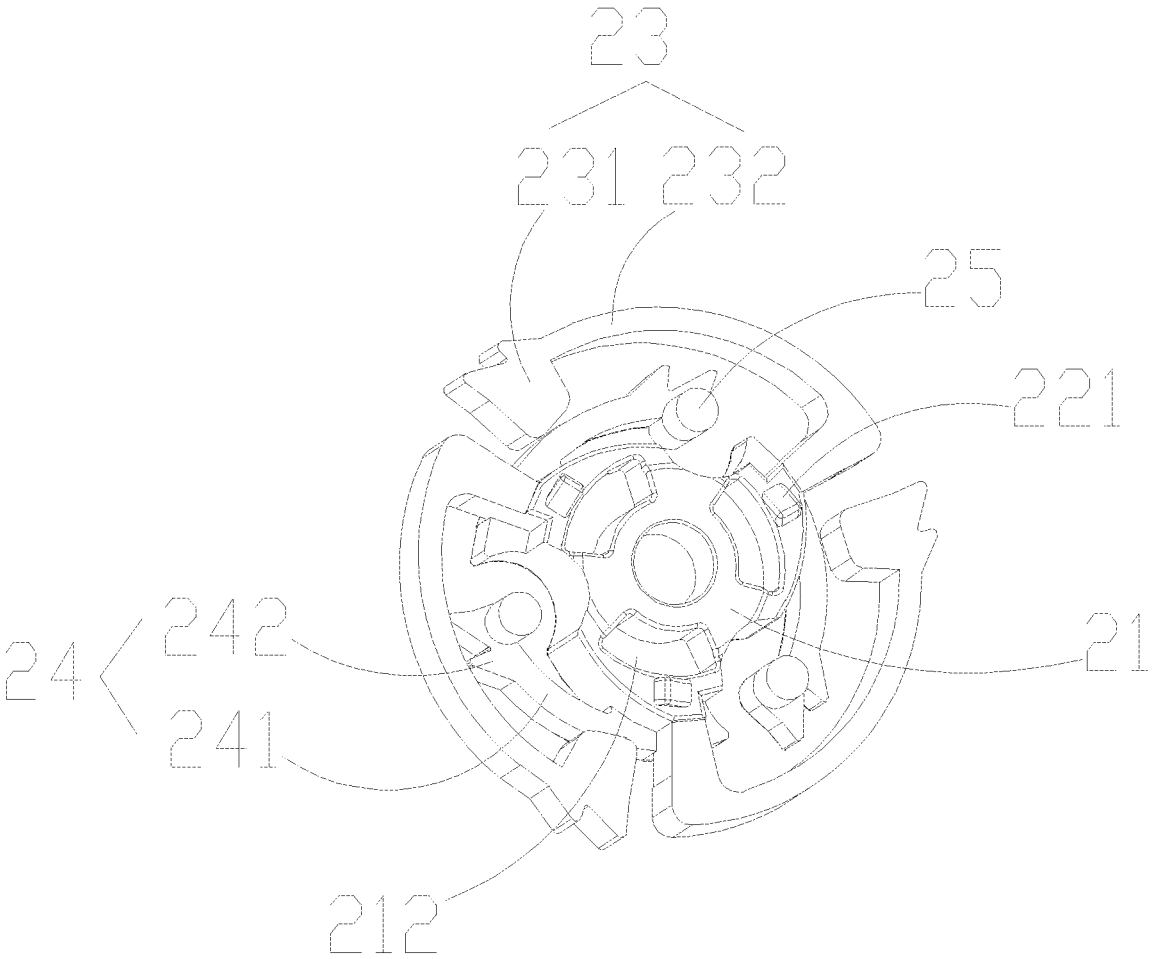

FIG. 14 is a space diagram of a pawl disc of the cord tightening and loosening device as shown in FIG. 11.

Figure 15:
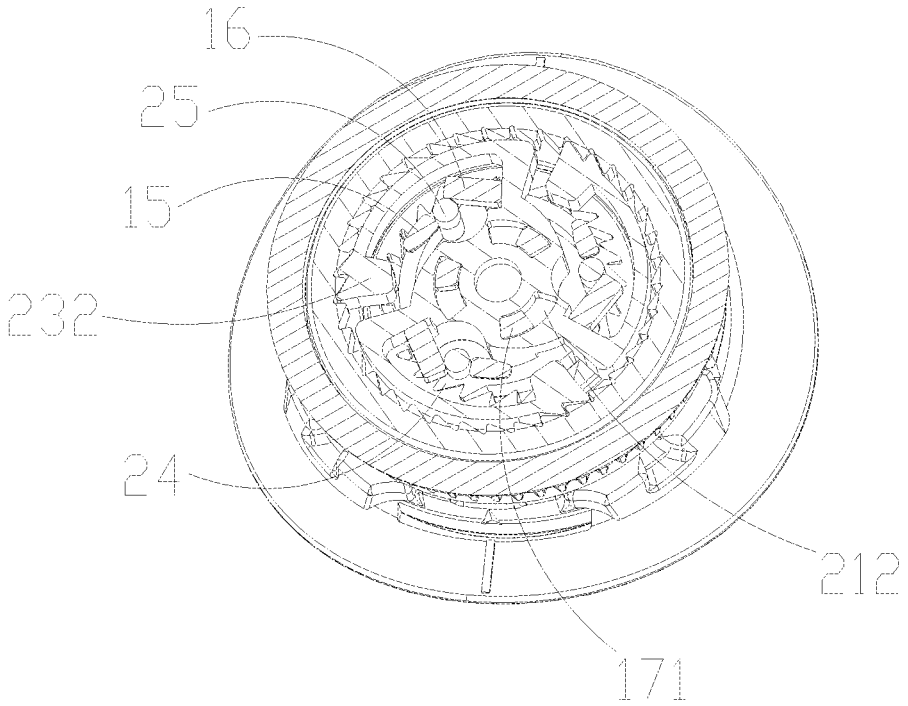

FIG. 15 is a section view of the cord tightening and loosening device as shown in FIG. 9 in a tightening state.

Figure 16:
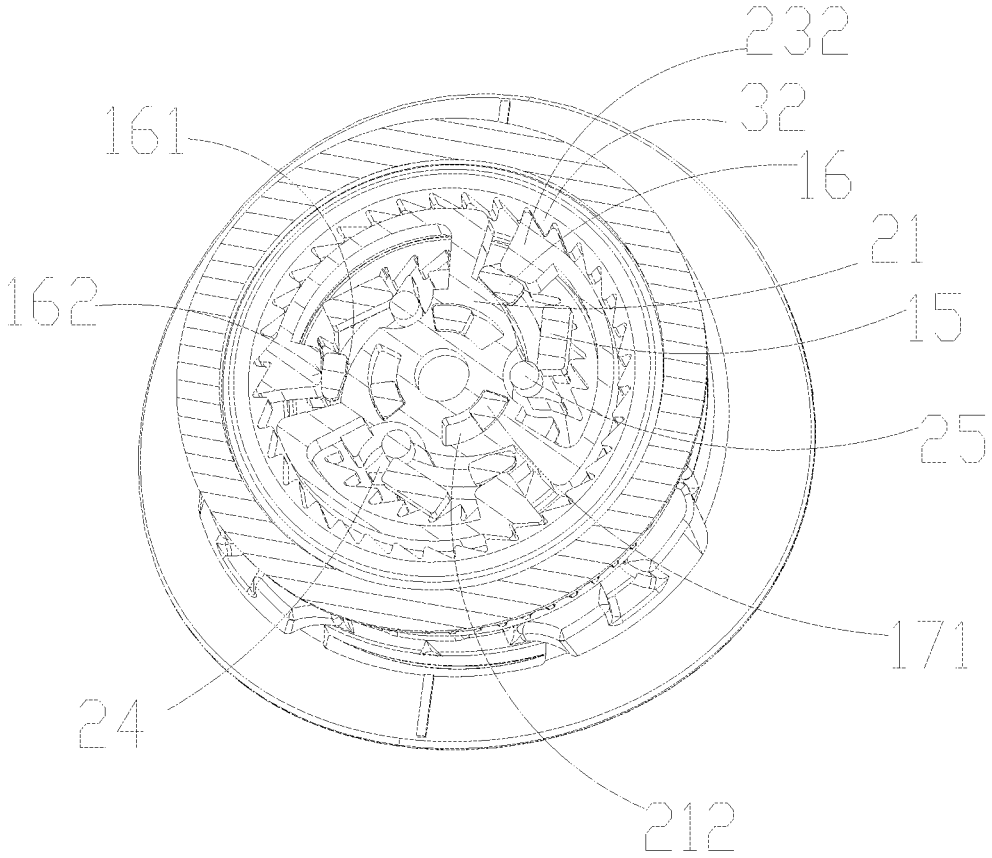

FIG. 16 is a section view of the cord tightening and loosening device as shown in FIG. 9 in a loosening state.

Figure 17:
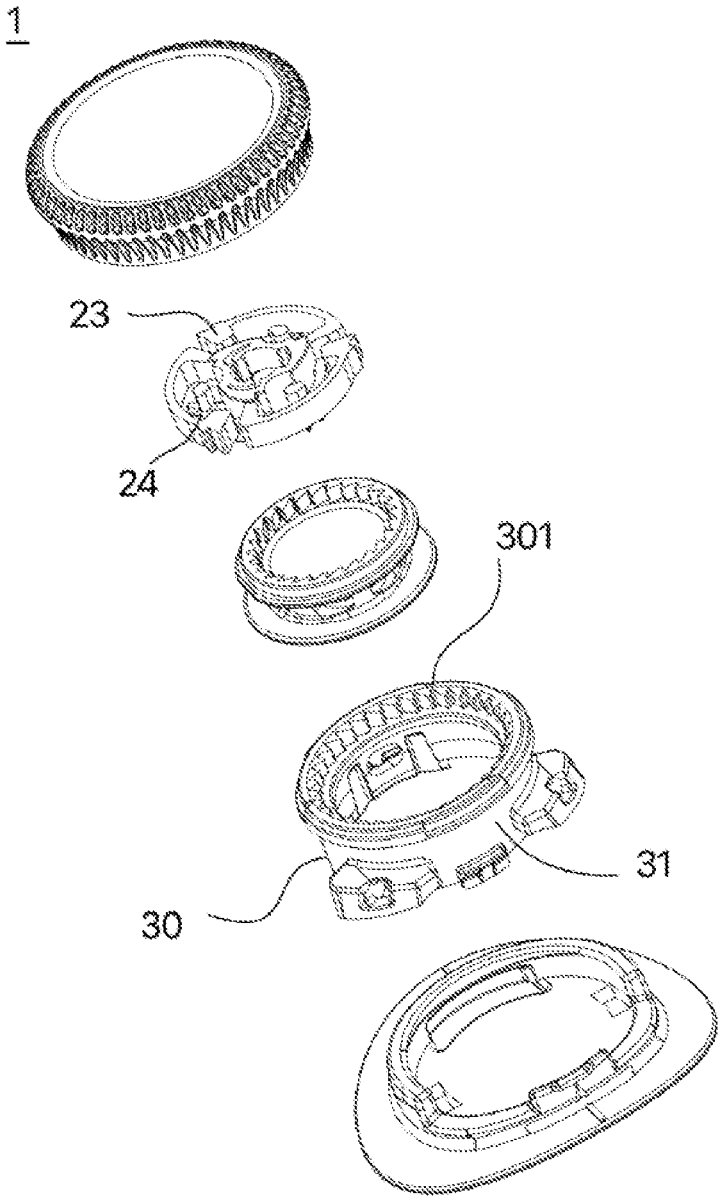

FIG. 17 is an explosive view of the cord tightening and loosening device in a third embodiment of the present disclosure.

Figure 18:
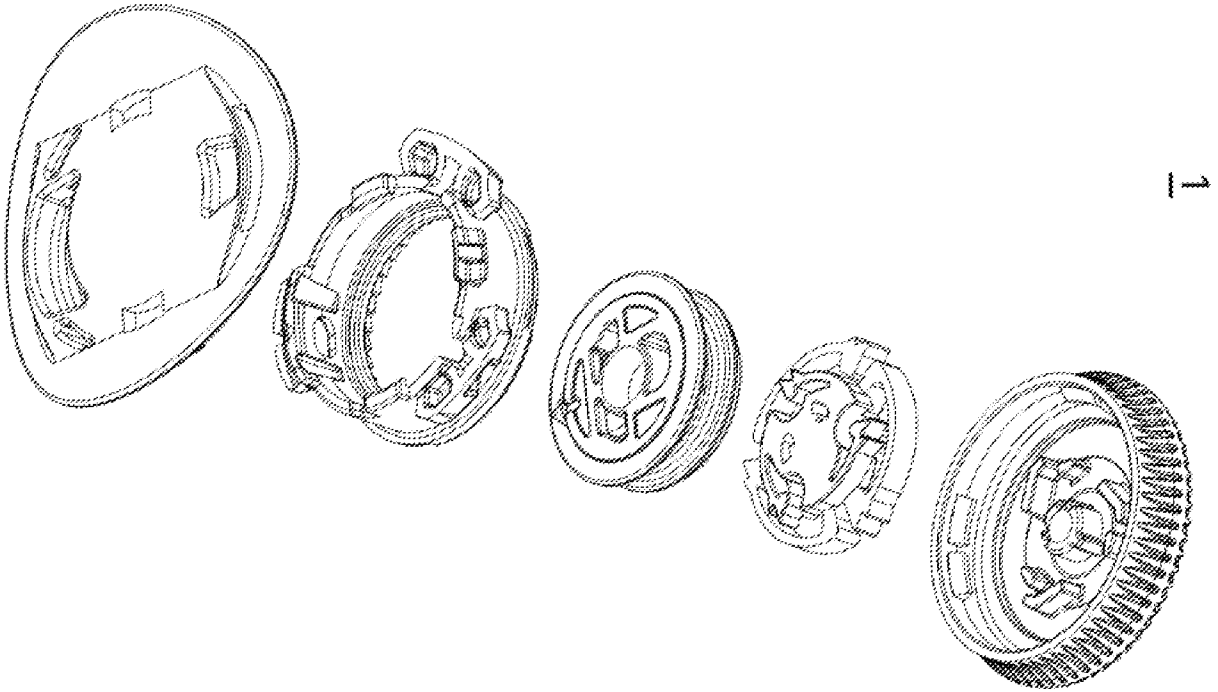

FIG. 18 is an explosive view of the cord tightening and loosening device as shown in FIG. 17 in another perspective.

Figure 19:
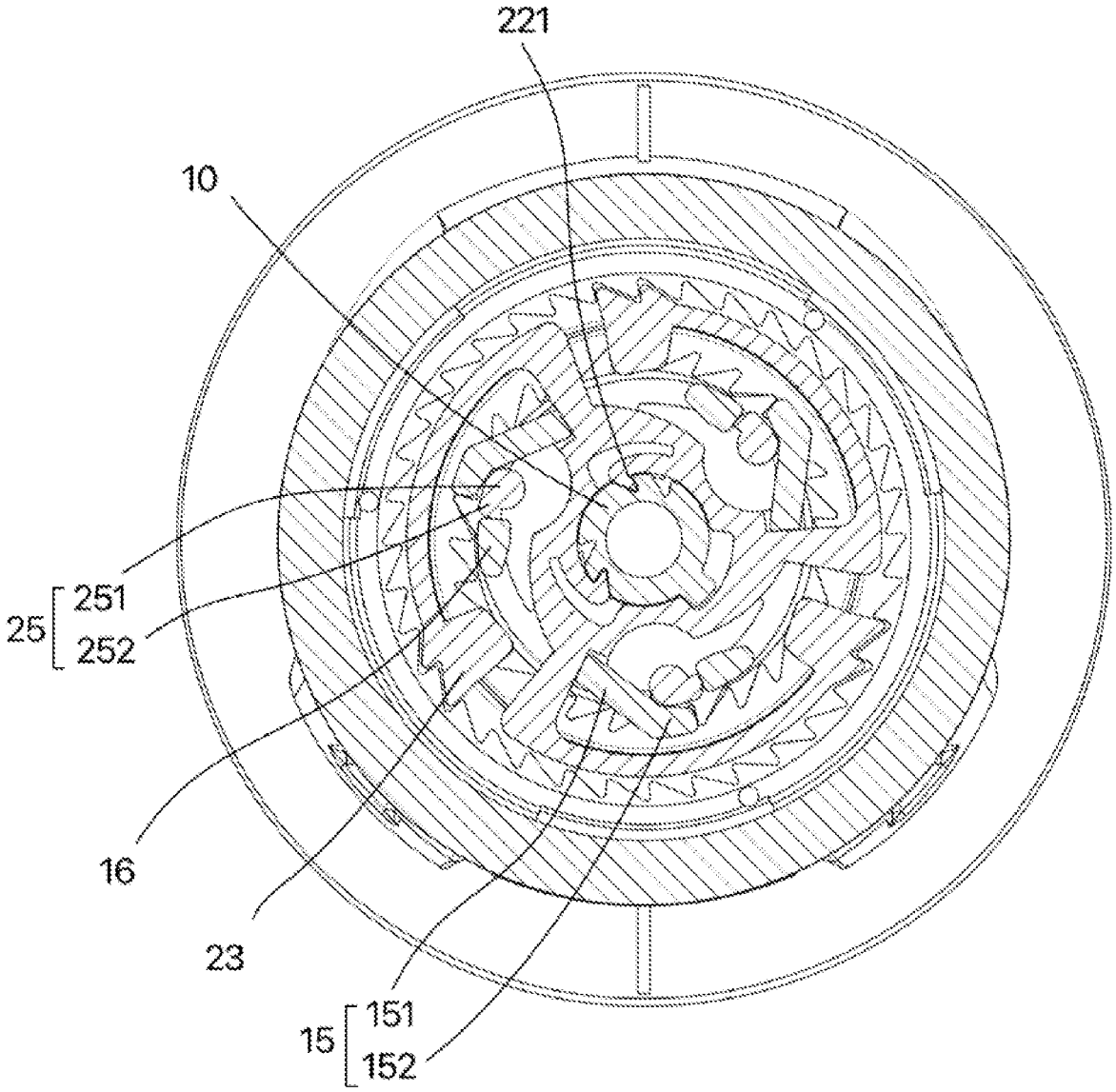

FIG. 19 is a section view of the cord tightening and loosening device as shown in FIG. 17 in a tightening state.

Figure 20:
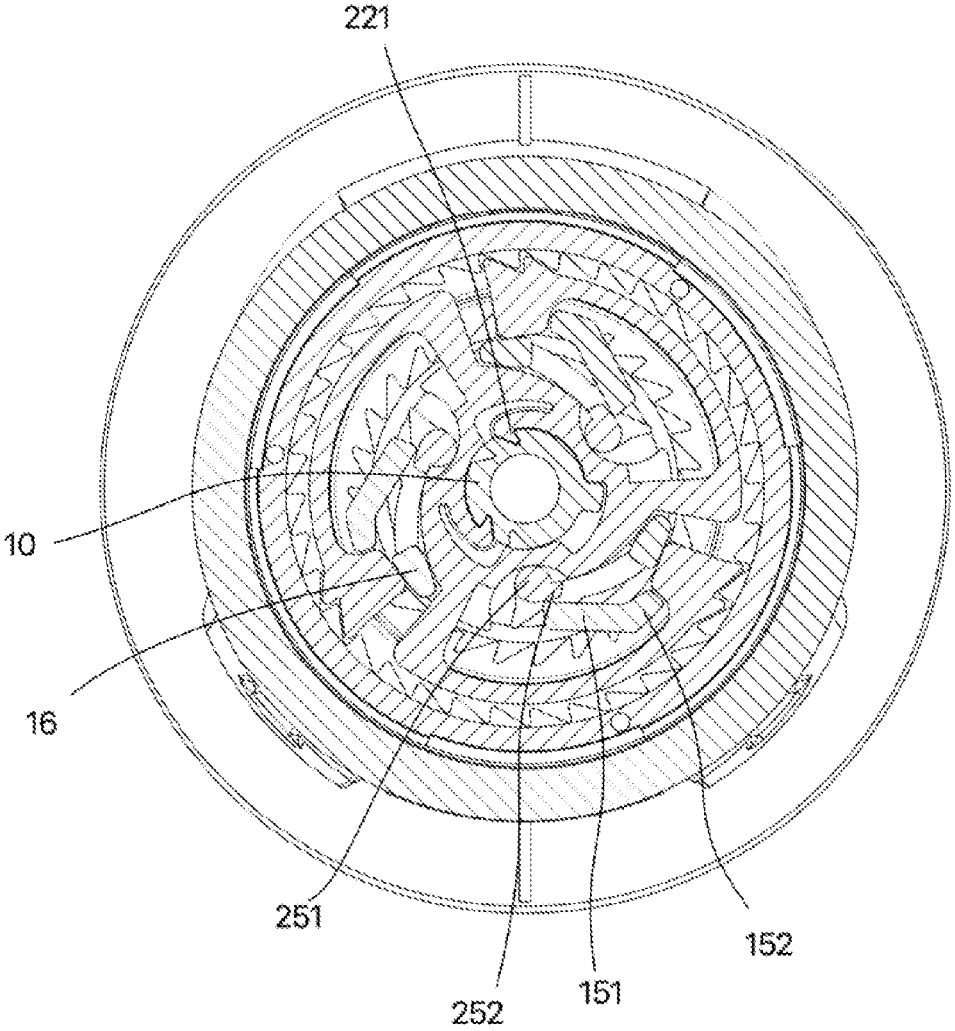

FIG. 20 is a section view of the cord tightening and loosening device as shown in FIG. 17 in a loosening state.

Figure 21:
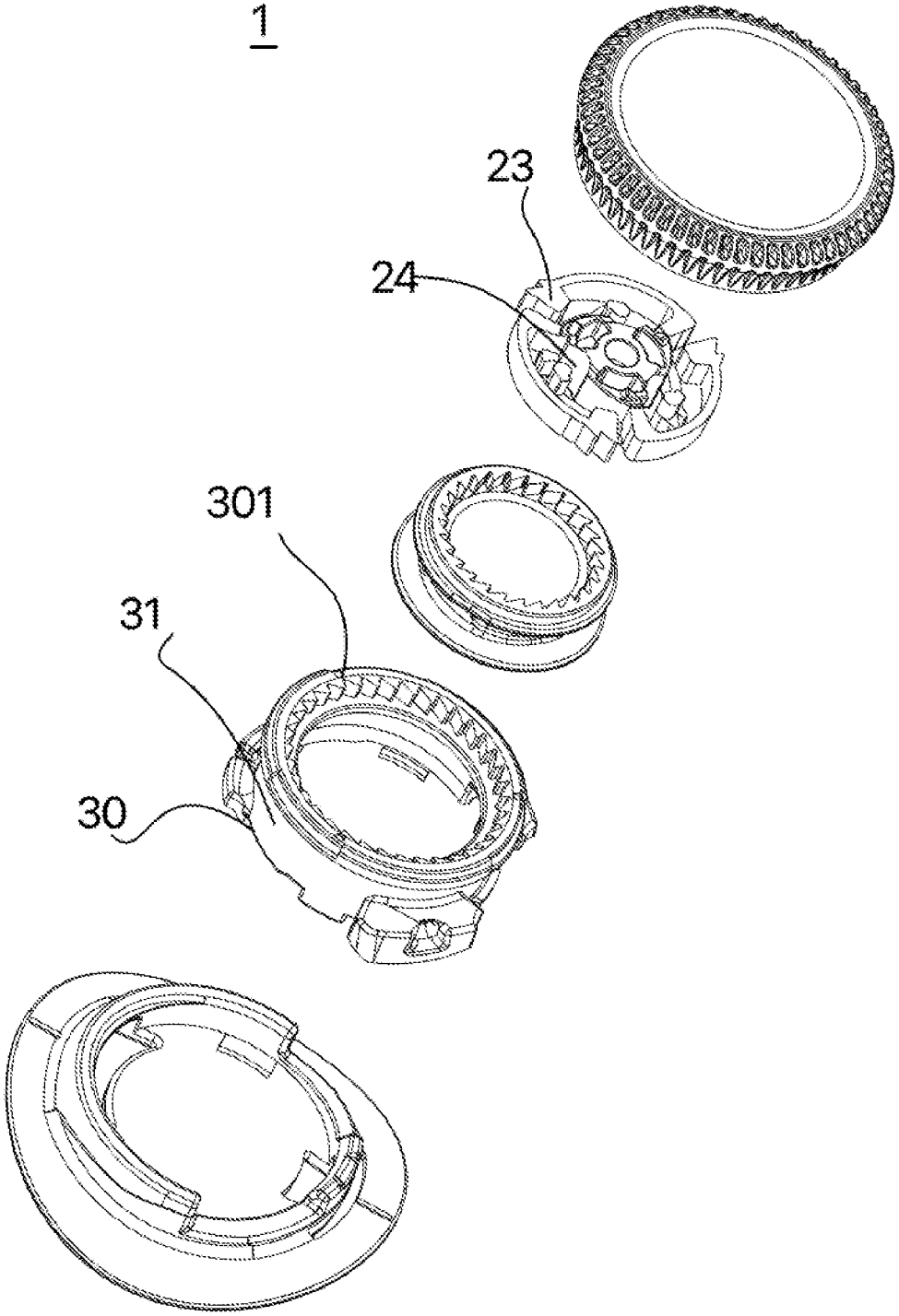

FIG. 21 is an explosive view of the cord tightening and loosening device in a fourth embodiment of the present disclosure.

Figure 22:
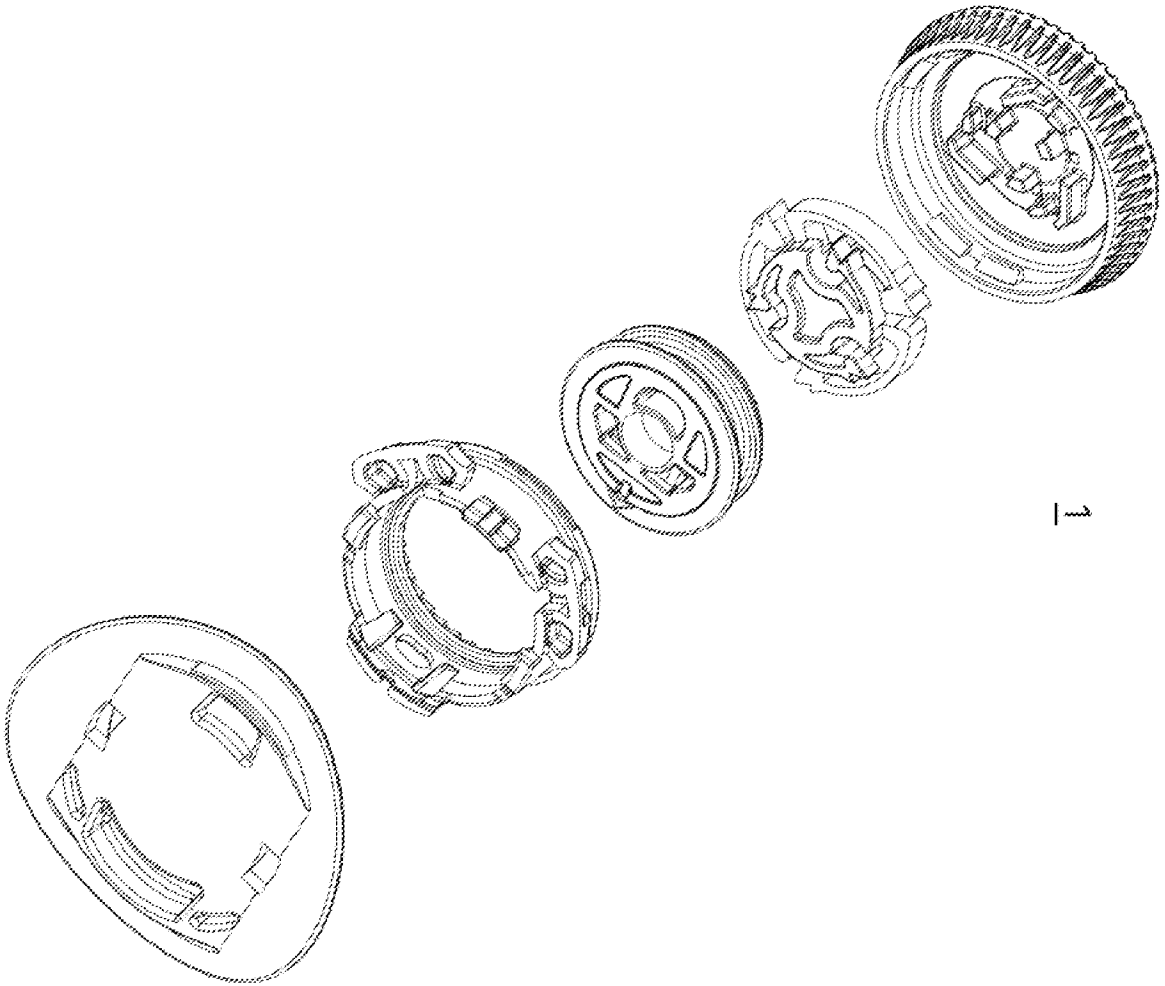

FIG. 22 is an explosive view of the cord tightening and loosening device as shown in FIG. 21 in another perspective.

Figure 23:
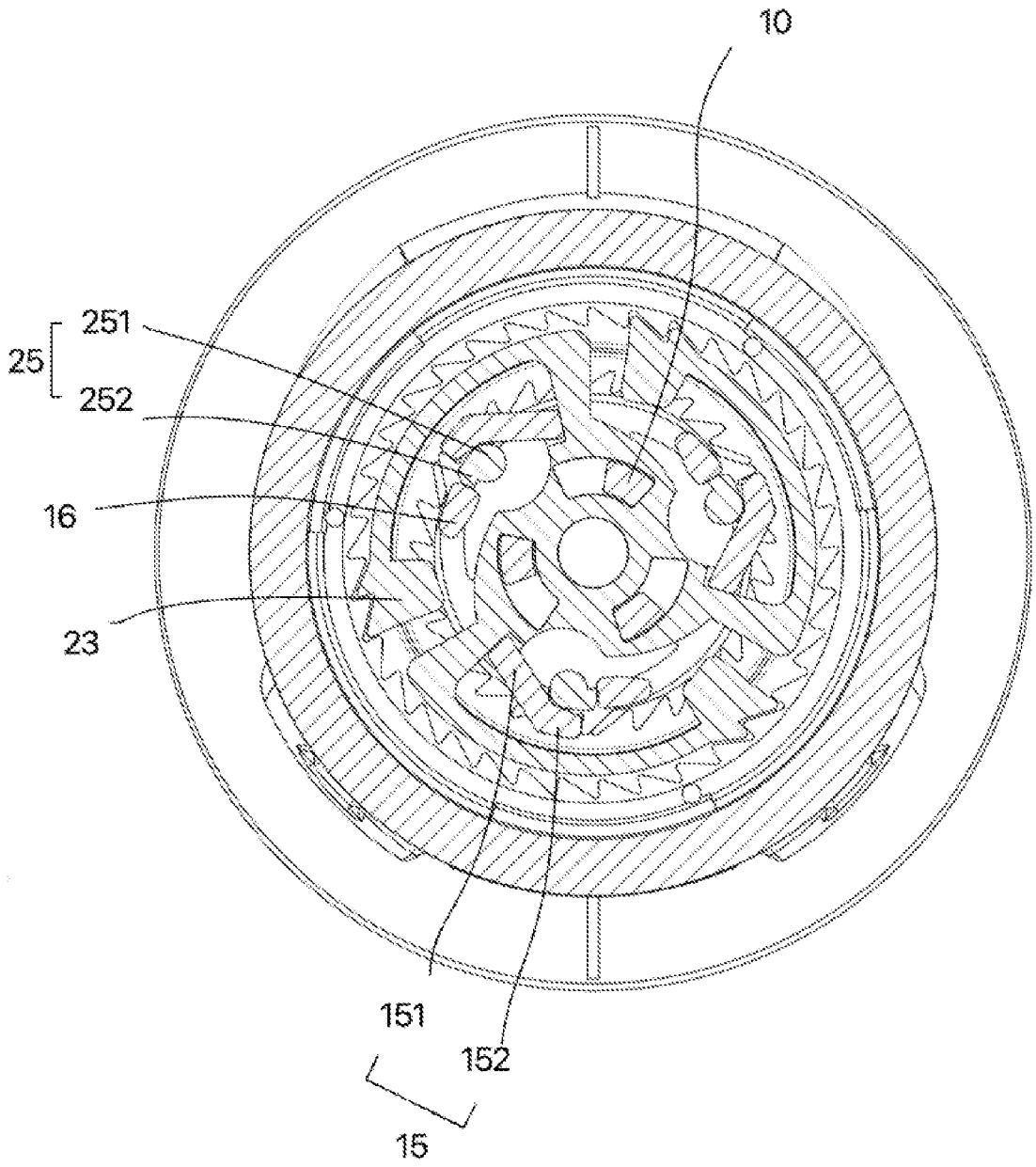

FIG. 23 is a section view of the cord tightening and loosening device as shown in FIG. 22 in a tightening state.

Figure 24:
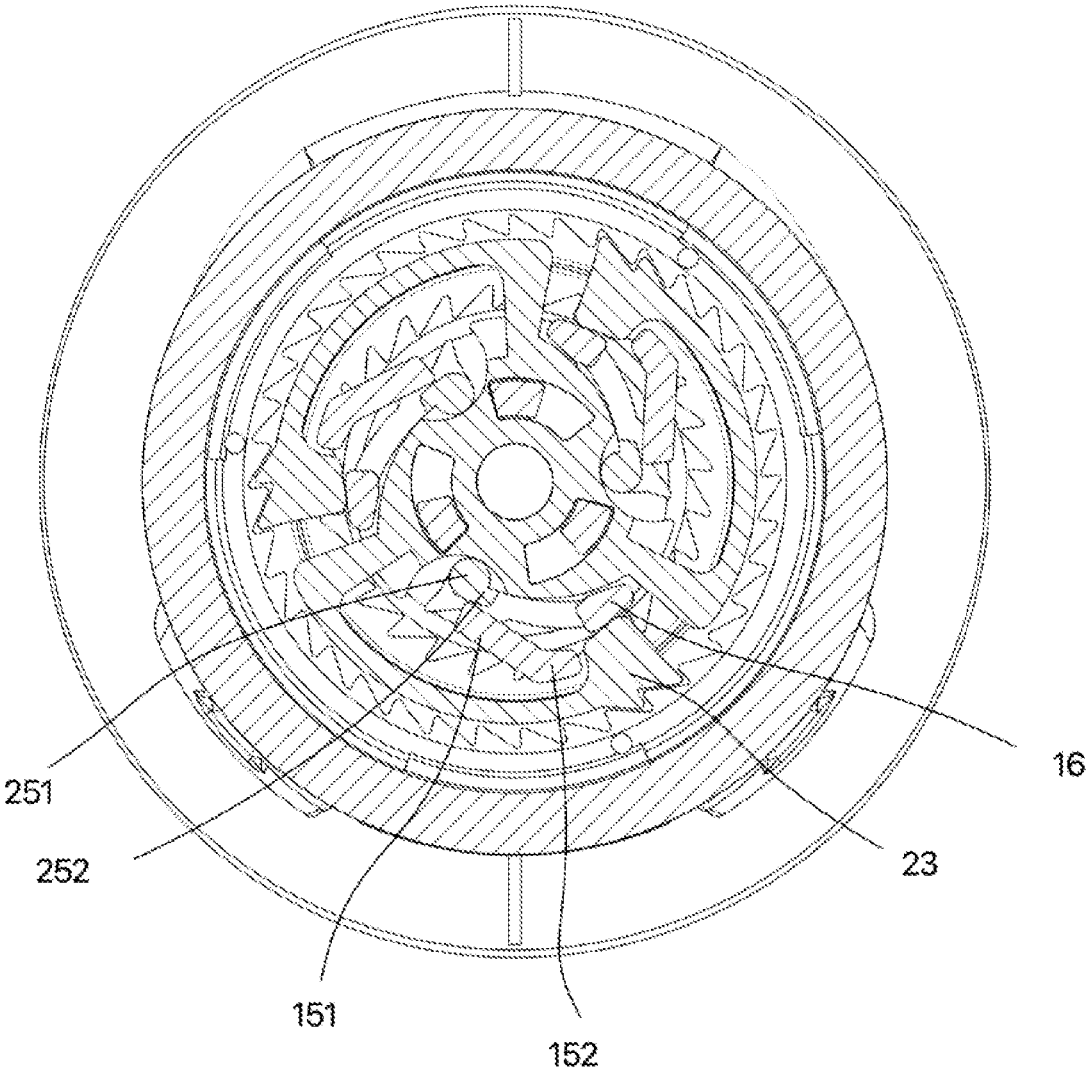

FIG. 24 is a section view of the cord tightening and loosening device as shown in FIG. 23 in a loosening state.

Figure 25:
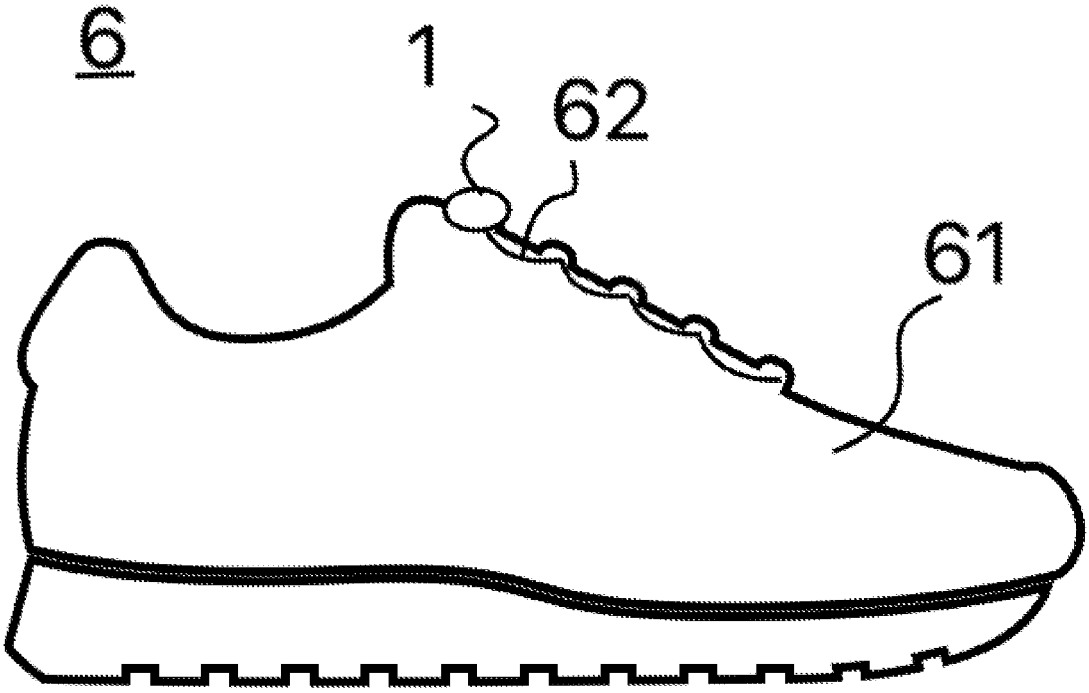

FIG. 25 is a structural schematic diagram of a shoe in an embodiment of the present disclosure.

Figure 26:
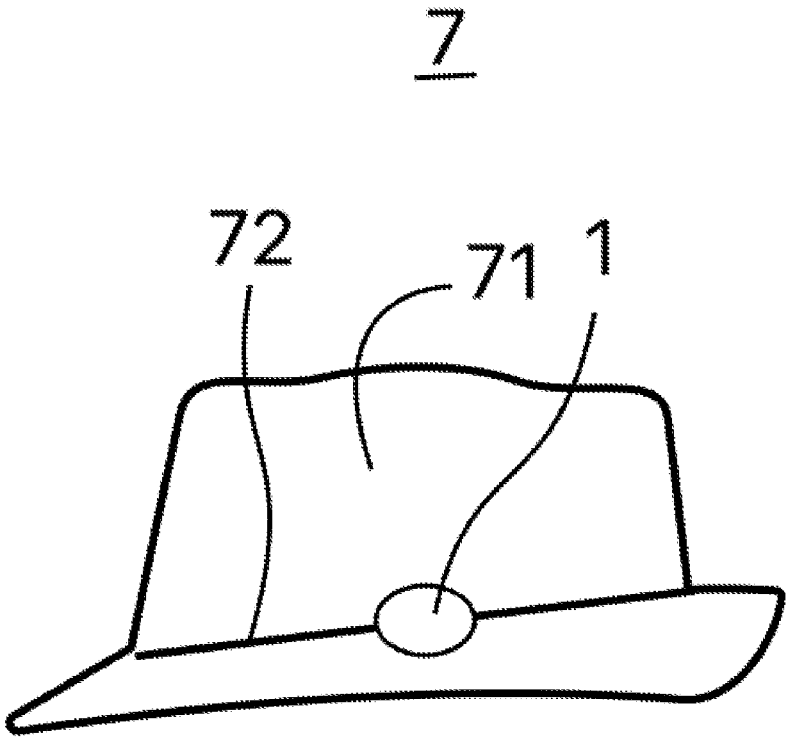

FIG. 26 is a structural schematic diagram of a cap in an embodiment of the present disclosure.

Figure 27:
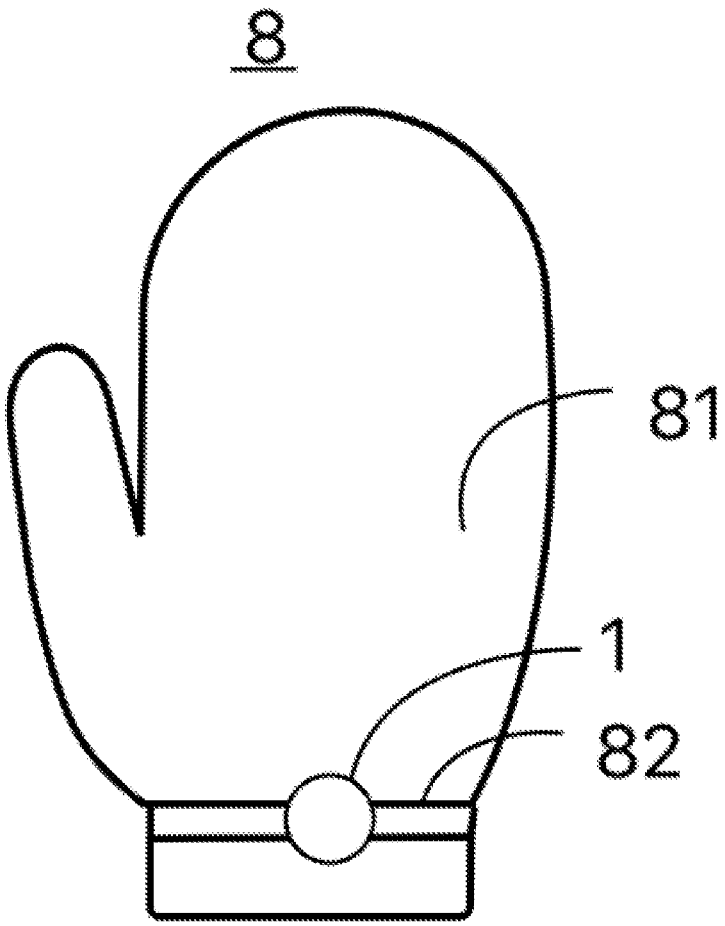

FIG. 27 is a structural schematic diagram of a glove in an embodiment of the present disclosure.

Figure 28:
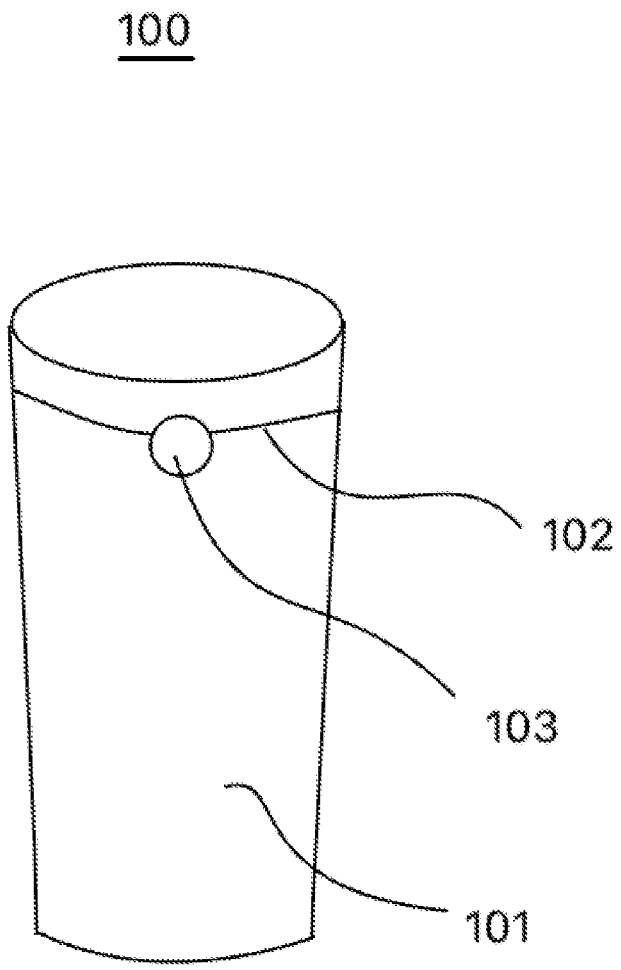

FIG. 28 is a structural schematic diagram of a medical protective equipment in an embodiment of the present disclosure.

Figure 29:
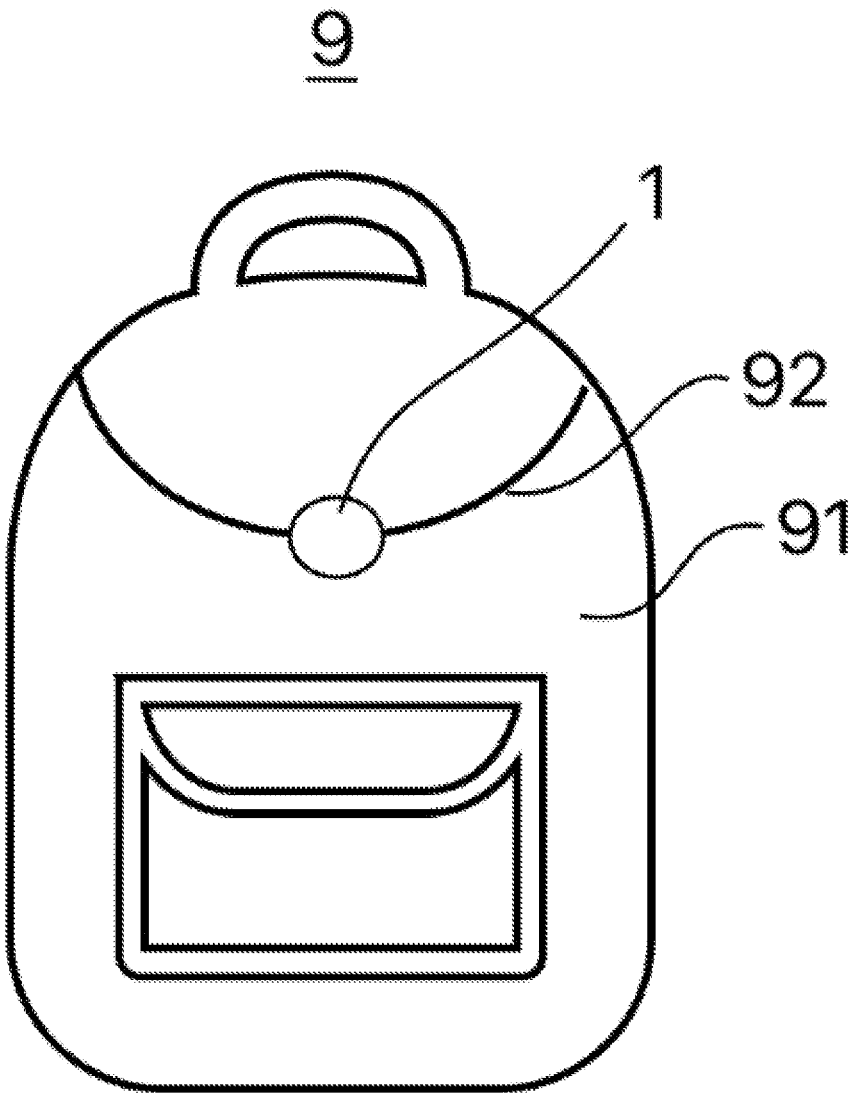

FIG. 29 is a structural schematic diagram of a storage device in an embodiment of the present disclosure.

DETAILED DESCRIPTION OF THE EMBODIMENTS

Referring to FIG. 1 to FIG. 16, a first embodiment and a second embodiment of the present disclosure provide a cord tightening and loosening device 1, including a rotary knob 10, a pawl disc 20, a base 30, a reel 40 and a chassis 50.

The rotary knob 10 includes a cover plate 11, a first clamping part 12 formed on one side of the cover plate 11, a driving member 15 formed on one side of the cover plate 11, a side plate 13 connected to one side of the cover plate 11, and a first limiting member 14 connected to the end, away from the cover plate 11, of the side plate 13.

The pawl disc 20 includes a base plate 21, a second clamping part 22 formed on the side, adjacent to the first clamping part 12, of the base plate 21 and used for being clamped with the first clamping part 12, a first check member 23 formed on an outer edge of the base plate 21, a first meshing part 24 formed between the base plate 21 and the first check member 23, and a connecting part 25 connected to the first meshing part 24.

The base 30 includes a side wall structure 31 annularly arranged on the circumference of the pawl disc 20, a second check member 32 formed on an inner surface of the side wall structure 31, and a second limiting member 33 formed on the side wall structure 31. The side wall structure 31 accommodates the pawl disc 20, a first cord inlet hole 34 is also formed in the side wall structure 31 in a penetrating manner, and the second check member 32 is meshed with the first check member 23, so that the pawl disc 20 can rotate relative to the base 30 along a predetermined clock direction. The second limiting member 33 extends into a storage space 110 surrounded by the cover plate 11 and the side plate 13, and can be limited in the storage space 110 by the first limiting member 14. The rotary knob 10 can drive the pawl disc 20 to rotate.

The reel 40 is located in the side wall structure 31 and arranged on the side, away from the rotary knob 10, the pawl disc 20, and includes two opposite base plate parts 42, a winding part 43 connected between the two base plate parts 42, an extended wall 41 connected to the base plate 21 close to the pawl disc, and a second meshing part 46 arranged on the inner side of the extended wall 41 and used for being matched with the first meshing part 24. The winding part 43 includes a second cord inlet hole 45, so that a cord can pass through the first cord inlet hole 34 and the second cord inlet hole 45 and is arranged on the reel 40.

The chassis 50 is located on the side, away from the reel 40, of the base plate part 42 and fixed with the base 30.

When the first meshing part 24 is meshed with the second meshing part 46 and the rotary knob 10 rotates in a first clock direction, the rotary knob 10 can drive the pawl disc 20 to rotate, and then the pawl disc 20 drives the reel 40 to rotate, so that the cord tightening and loosening device 1 can be in a tightening state and the cord can be wound around the winding part 43 of the reel 40 to tighten the cord.

When the rotary knob 10 rotates in a second clock direction opposite to the first clock direction, the driving member 15 drives the connecting part 25, the first meshing part 24 is separated from the second meshing part 46, the cord tightening and loosening device 1 is in a loosening state, and then the reel 40 can rotate to realize the release of the cord.

Compared with the prior art, in the cord tightening and loosening device 1 of the present disclosure, when the first meshing part 24 of the pawl disc 20 is meshed with the second meshing part 46 of the reel 40 and the rotary knob 10 rotates in a first clock direction, the rotary knob 10 can drive the pawl disc 20 to rotate, and then the pawl disc 20 drives the reel 40 to rotate, so that the cord tightening and loosening device 1 can be in a tightening state and the cord can be wound around the winding part 43 of the reel 40 to tighten the cord. When the rotary knob 10 rotates in a second clock direction opposite to the first clock direction, the driving member 15 of the rotary knob 10 drives the connecting part 25 of the pawl disc 20, the first meshing part 24 of the pawl disc 20 is separated from the second meshing part 46 of the reel 40, the cord tightening and loosening device 1 is in a loosening state, and then the reel 40 can rotate to realize the release of the cord. The cord tightening and loosening device 1 can tighten the cord through forward rotation and loosen the cord through reverse rotation, and is simple in operation and high in user experience. In addition, the number of whole components of the cord tightening and loosening device 1 is small, thus reducing the assembly cost and improving the assembly efficiency. The whole structure is compact, thus facilitating the miniaturization and lightweight of the cord tightening and loosening device 1. Moreover, the small number of the components can also improve the stability of the whole structure, so that the reliability of the cord tightening and loosening device 1 is improved, and the service life of the cord tightening and loosening device 1 is prolonged. It is understood that the forward rotation refers to rotation in the first clock direction, and the reverse rotation is rotation in the second clock direction opposite to the first clock direction, wherein, in an embodiment, the first clock direction may be the clockwise direction and the second clock direction may be the counterclockwise direction. In other embodiments, the first clock direction may be the counterclockwise direction, and the second clock direction may be the clockwise direction.

Further, the rotary knob 10 also includes a top block 16 arranged on one side of the cover plate 11, and the top block 16 is used for abutting between the inner side of the first check member 23 and the winding part 43 in the loosening state to prevent the first check member 23 from being separated from the second check member 32. It can be understood that the top block 16 can prevent the first check member 23 from being separated from the second check member 32 in the loosening state, thus facilitating switching from the loosening state to the tightening state and improving the reliability of the cord tightening and tightening device 1.

In the first and second embodiments, the top block 16 includes an inner side surface 161 and an outer side surface 162, and the distance between the inner side surface 161 and the outer side surface 162 is gradually decreased along the first clock direction. Through the top block 16, it is convenient for the top block 16 to gradually increase the abutting force, thus effectively abutting against and preventing the first check member 23 from being separated from the second check member 32.

In the first and second embodiments, the connecting part 25 is a cylinder, and a side surface of the driving member 15 is used for abutting against an outer circumferential surface of the cylinder to drive the connecting part 25. It can be understood that the connecting part 25 is a cylinder and the side surface of the driving member 15 is used for abutting against the outer circumferential surface of the cylinder, so that the driving member 15 can smoothly drive the connecting part 25, and the switching of the cord tightening and loosening device 1 from the tightening state to the loosening state is successfully completed.

In the first and second embodiments, the first clamping part 12 includes an anti-forward rotation clamping part 122 and an anti-reverse rotation clamping part 121. When the cord tightening and loosening device 1 is in the tightening state, the anti-reverse rotation clamping part 121 is clamped with the second clamping part 22. When the cord tightening and loosening device 1 is in the loosening state, the anti-forward rotation clamping part 122 is clamped with the second clamping part 22. Through the anti-forward rotation clamping part 122 and the anti-reverse rotation clamping part 121, a rotation phenomenon caused by accidental contact or automatic rebound can be effectively prevented, and the reliability of the cord tightening and loosening device 1 can be improved.

Further, the number of the second clamping parts 22 is at least two, the second clamping parts 22 are distributed in turn along the circumferential direction, the numbers of the anti-forward rotation clamping parts 122 and the anti-reverse rotation clamping parts 121 are both at least two, and the anti-forward rotation clamping parts 122 and the anti-reverse rotation clamping parts 121 are distributed in turn along the circumferential direction. The numbers of the first clamping parts 24 and the connecting parts 25 are both at least two, and the first clamping parts 24 and the connecting parts 25 are distributed in turn along the circumferential direction. The numbers of the first check members 23 and the second check members 24 are at least two, and the first check members 23 and the second check members 24 are distributed in turn along the circumferential direction. The numbers of the driving members 15 and the top blocks 16 are consistent with and corresponding to the number of the connecting parts 25. The first check member 23 includes an elastic arm 231 and a first check tooth 232 connected with the elastic arm 231, and the second check member 32 includes a plurality of second check teeth connected in turn along the circumferential direction. The first meshing part 24 includes a connecting arm 241 and a first meshing tooth 242 connected to the connecting arm 241, and the second meshing part 46 includes a plurality of second meshing teeth connected in turn along the circumferential direction. It can be understood that the technical effect of improving the stability and reliability of the cord tightening and loosening device 1 can be achieved through the arrangement of the second clamping parts 22, the anti-forward rotation clamping parts 122, the anti-reverse rotation clamping parts 121, the first meshing parts 24, the connecting parts 25, the first check members 23, the second check members 32, the driving members 15, the top blocks 16, the second check teeth and the second meshing teeth. Specifically, the numbers of the second clamping parts 22, the anti-forward rotation clamping parts 122, and the anti-reverse rotation clamping parts 121 may be two, the numbers of the first meshing parts 24, the connecting parts, the first check members 23, the driving members 15 and the top blocks 16 may be three, and the numbers of the second check teeth and the second meshing teeth may be plural.

Specifically, as shown in FIG. 8 and FIG. 16, when in the loosening state, the top block 16 abuts against the first check tooth 232 of the first check member 23, and then the first check member 23 abuts against and is meshed with the second check member 32. When starting of the forward rotation is prevented, the rotary knob 10 and the second check member 32 start rotating at the same time. In this case, the driving member 15 and the connecting part 25 cannot be out of contact or are unable to be out of contact, so the first meshing tooth 242 of the first meshing part 24 cannot be remeshed with the second meshing part 46 of the reel 40 to tighten the cord temporarily. That is to say, after the top block 16 forcibly abuts the first check tooth 232 against the second check member 32, when the rotary knob 10 rotates, because of the blocking of the top block 16, the first check tooth 232 cannot rotate and slides out of the second check member 32, so that the pawl disc 20 cannot rotate either. In this case, the rotary knob 10 can rotate forward at a certain angle (for example, the second clamping part 22 is separated from the anti-forward rotation clamping part 122 and meshed with the anti-reverse rotation clamping part 121) in advance. At the same time, the driving member 15 and the connecting part also rotate at an angle. At this time, the driving member 15 and the connecting part 25 are out of contact, so that the first meshing tooth 242 of the first meshing part 24 can be remeshed with the second meshing part 46 of the reel 40, and then the tightening state is switched to realize winding.

It can be understood that in the rotary knob 10, the side plate 13 is an annular side plate connected to an outer edge of the cover plate 11. An anti-skid structure 131 is also formed on an outer side surface of the side plate 13. The anti-skid structure 131 may include a plurality of anti-skid grooves extending in the direction perpendicular to the cover plate 11. The anti-skid grooves are arranged annularly along the outer side surface of the side plate 13. The anti-skid structure 131 is also formed on the outer side surface of the side plate 13, so that an anti-skid effect can be achieved when the rotary knob 10 rotates, and the operation is convenient. The first limiting member 14 may include at least two first extended parts 141 extending from the side plate 13 toward the inside. The second limiting member 33 includes a second extended part 331 protruding outward from the side wall structure 31. The second extended part 331 is of an annular structure. The second extended part 331 can extend into the storage space surrounded by the side plate 13 and the cover plate 11, and is clamped and fixed with the side, adjacent to the cover plate 11, of the first extended part 141. Through the arrangement of the second extended part 331 of an annular structure and the first extended parts 141, the second extended part 331 can extend into the storage space surrounded by the side plate 13 and the cover plate 11 and is free of the influence of the positions of the first extended part 141 and the second extended parts 331 when being clamped and fixed with the side, adjacent to the cover plate 11, of the first extended part 141, so that the operation is simpler.

Further, it can be understood that in the pawl disc 20, the end, away from the first check tooth 232, of the elastic arm 231 is connected to the outer edge of the base plate 21. The elastic arm 231 can be deformed to drive the first check tooth 232 to move in the direction toward or away from the base plate 21. In a natural state of the elastic arm 231, the first check tooth 232 gets away from and is spaced from the base plate 21. In the base 30, the second check teeth are connected in turn along the first clock direction and annularly arranged on the inner surface of the side wall structure 31. The second check teeth are meshed with the first check teeth 232, and the first check teeth 232 can rotate relative to the second check teeth in the first clock direction and are meshed with the different second check teeth, so that the rotary knob 10 can drive the pawl disc 20 to rotate. The operation is simple, and the structure is stable. It can be understood that the first check teeth 232 can only rotate relative to the second check teeth in the first clock direction (such as the clockwise direction) and are meshed with the different second check teeth under the action of the external force, and cannot rotate in the reverse direction, thus achieving a check effect. In addition, in the embodiment, the first clock direction may be the clockwise direction, and the second clock direction may be the counterclockwise direction, but not limited thereto. In a modified embodiment, the first clock direction also may be the counterclockwise direction, and the second clock direction also may be the clockwise direction. Moreover, the installation of the pawl disc 20 may be facilitated by providing the elastic arm 231.

In the reel 40, the two base plate parts 42 and the winding part 43 connected between the two base plate parts 42 can form a storage part 49 for storing the cord. The cord can be neatly stored on the reel 40 through the storage part 49, so that the cord is prevented from being drawn in other positions to cause influence on other components. Further, the base plate part 42 away from the pawl disc 20 also includes at least one slot 44 communicating with the second cord inlet hole 45, and the slot 44 is used for accommodating a knot for limiting the cord. Through the arrangement of the slot 44, the knot of the cord thread is accommodated, the knot can be limited, and the phenomena such as knot jamming and breaking away from the reel can be effectively avoided. It can be understood that the numbers of the second cord inlet holes 45 and the slots 44 may be two, so that both ends of a cord can pass through the second cord inlet holes 45 and the slots 44, respectively. The two slots 44 may accommodate two knots at both ends.

Furthermore, the base 30 also includes an extended wall 36 extending from the side wall structure 31 toward a fixed part. The extended wall 36 can be spaced from the second check member 32 from the reel 40 to avoid mutual interference. The base 30 also includes a first cord inlet part 37 corresponding to the first cord inlet hole 34, the first cord inlet part 37 includes a first cord inlet slot 371 communicating with the first cord inlet hole 34, and the width of the first cord inlet slot 371 may be gradually increased in the direction away from the first cord inlet hole 34. It can be understood that the numbers of the first cord inlet holes 34, the first role inlet parts 37 and the second cord inlet holes 45 can be set, and are usually two. Each end of both ends of the cord can be arranged on the reel 40 after passing through the corresponding first cord inlet slot 371 and then passing through the corresponding first cord inlet hole 34 and the corresponding second cord inlet hole 45. For example, when the cord is knotted and pulled, the cord can still be clamped on the reel without being fallen off. Further, in order to facilitate the knotting of both ends of the cord after passing through the base 30, the base 30 may also include a through hole 38 penetrating through the side wall structure 31. Each end of the cord may pass through the corresponding first cord inlet slot 371 and then through the corresponding first cord inlet hole 34, and pass through the second cord inlet hole 45 and then through the through hole 38, and thus each end is exposed out of the base 30. At this time, each end of the cord may be knotted. It can be understood that the tightening and loosening operation is facilitated by the width of the first cord inlet slot 371 gradually increased in the direction away from the first cord inlet hole 34.

The chassis 50 is also fastened with the base 30. The chassis 50 may include a bottom plate 51. A first fastening groove 52 and a second fastening groove 53 are formed in the bottom plate 51. The first fastening groove 52 and the second fastening groove 53 are arranged at intervals. The base 30 also includes a first clamping member 311 and a second clamping member 312 connected to the outer side surface of the side wall structure 31. The first clamping member 311 and the second clamping member 312 are arranged at intervals and correspond to the first fastening groove 52 and the second fastening groove 53, respectively. The first clamping member 311 can extend into the first fastening groove 52 to be clamped with the side, away from the base 30, of the bottom plate 51. The second clamping member 312 can extend into the second fastening groove 53 to be clamped with the side, away from the base 30, of the bottom plate 51. The first clamping member 311 and the second clamping member 312 are both arc-shaped, and the first fastening groove 52 and the second fastening groove 53 are both arc-shaped. The chassis 50 also includes a side wall part 54 connected to the side, adjacent to the base 30, the bottom plate 51. At least part of the side wall structure 31 is accommodated by the side wall part 54 and the bottom plate 51 together. A notch is also formed in the side wall part 54 corresponding to the first cord inlet hole 34.

The first fastening groove 52 and the second fastening groove 53 are formed in the bottom plate 51. The first clamping member 311 and the second clamping member 312 are arranged on the outer side surface of the side wall structure 31. The first clamping member 311 can extend into the first fastening groove 52 to be clamped with the side, away from the base 30, of the bottom plate 51. The second fastening member 312 can extend into the second fastening groove 53 to be clamped with the side, away from the base 30, the bottom plate 51. At least part of the side wall structure 31 is accommodated by the side wall part 54 and the bottom plate 51 together, so that the overall structure is compact, and miniaturization and lightweight of the cord tightening and loosening device 1 are facilitated. Moreover, the stability of the overall structure also can be improved.

As shown in FIG. 1 to FIG. 8, in the first embodiment, the rotary knob 10 includes a raised structure 17 arranged in a middle area of the cover plate 11. The anti-forward rotation clamping part 122 and the anti-reverse rotation clamping part 121 are grooves 123 formed in an outer side surface of the raised structure 17 in turn. The base plate 21 includes a groove structure 21 formed in a middle area. The second clamping part 22 includes a hook 221 extending into the groove structure 211. The hook 221 is used for being clamped with the groove 123 of the anti-forward rotation clamping part 122 or the groove 123 of the anti-reverse rotation clamping part 121. Since the hook 221 and the groove structure 211 are simple and high in reliability, through the cooperation between the hook 221 and the groove 123, a rotation phenomenon caused by accidental contact or automatic rebound can be effectively prevented, and the reliability of the cord tightening and loosening device 1 is improved.

In the first embodiment, the outer side surface of the raised structure 17 is also provided with a first limiting part 171. A side wall surface of the groove structure 211 is also provided with a second limiting part 212. One of the first limiting part 171 and the second limiting part 212 is a limiting block, and the other of the first limiting part 171 and the second limiting part 212 is a limiting chute. The limiting block is used for sliding in the limiting chute to limit a relative rotation angle of the rotary knob 10 and the pawl disc 20, so that the anti-forward rotation clamping part 122 and the anti-reverse rotation clamping part 121 of the rotary knob 10 are meshed with or separated from the second clamping part 22 of the pawl disc 20 in turn. It can be understood that due to simple structure and high reliability of the limiting block and the limiting chute, the relative rotation angle between the rotary knob 10 and the pawl disc 20 can be limited through the cooperation between the limiting block and the limiting chute, and the anti-forward rotation clamping part 122 and the anti-reverse rotation clamping part 121 of the rotary knob 10 can be meshed with or separated from the second clamping part 22 of the pawl disc 20 in turn, so that the stability and user experience of the cord tightening and loosening device 1 are improved.

In the first embodiment, the groove 123 includes a first surface 124 and a second surface 125 which are bent and connected. The raised structure 17 is provided with an arc surface connected to the first surface 124 and the second surface 125. The angle between the first surface 124 and the tangent line of a connection point of the arc surface of the part where the first surface 124 is connected and is different from the angle between the second surface 125 and the tangent line of a connection point of the arc surface of the part where the second surface 125 is connected, so that the external force required for separating the hook 221 from the groove 123 of the anti-forward rotation clamping part 122 is less than the external force required for separating the hook 221 from the groove 123 of the anti-reverse rotation clamping part 121. It can be understood that through the arrangement of the above structure, the external force required for separating the hook 221 from the groove 123 of the anti-forward rotation clamping part 122 can be less than the external force required for separating the hook 221 from the groove 123 of the anti-reverse rotation clamping part 121, so that the user experience is improved.

As shown in FIG. 9 to FIG. 16, in the second embodiment, the anti-forward rotation clamping part 122 and the anti-reverse rotation clamping part 121 are grooves 123 formed in the cover plate 11 in turn along the circumferential direction. The second clamping part 22 is a clamping block 221 arranged on the winding part 43. The clamping block is used for being clamped with the groove 123 of the anti-forward rotation clamping part 122 or the groove 123 of the anti-reverse rotation clamping part 121. Since the clamping block and the groove structure 211 are simple and high in reliability, through the cooperation between the clamping block and the groove 123, a rotation phenomenon caused by accidental contact or automatic rebound can be effectively prevented, and the reliability of the cord tightening and loosening device 1 is improved.

In the second embodiment, one side of the cover plate 11 is also provided with a first limiting part 171. The side, close to the cover plate 11, of the winding part 43 is also provided with a second limiting part 212. One of the first limiting part 171 and the second limiting part 212 is a limiting block, and the other of the first limiting part 171 and the second limiting part 212 is a limiting chute. The limiting block is used for sliding in the limiting chute to limit a relative rotation angle between the rotary knob 10 and the pawl disc 20, so that the anti-forward rotation clamping part 122 and the anti-reverse rotation clamping part 121 of the rotary knob 10 are meshed with or separated from the second clamping part 22 of the pawl disc 20 in turn. The numbers of the first limiting parts 171 and the second limiting parts 212 are at least two. The first limiting parts 171 and the second limiting parts 212 are distributed along the circumferential direction. It can be understood that due to simple structure and high reliability of the limiting block and the limiting chute, the relative rotation angle between the rotary knob 10 and the pawl disc 20 can be limited through the cooperation between the limiting block and the limiting chute, and the anti-forward rotation clamping part 122 and the anti-reverse rotation clamping part 121 of the rotary knob 10 can be meshed with or separated from the second clamping part 22 of the pawl disc 20 in turn, so that the stability and user experience of the cord tightening and loosening device 1 are improved.

In the second embodiment, the groove 123 includes a first surface 124 and a second surface 125 which are bent and connected, and the angle between a body surface on one side of the cover plate 11 and the first surface 124 is different from the angle between the body surface on one side of the cover plate 11 and the second surface 125, so that the external force required for separating the clamping block from the groove 123 of the anti-forward rotation clamping part 122 is less than the external force required for separating the clamping block from the groove 123 of the anti-reverse rotation clamping part 121. It can be understood that through the arrangement of the above structure, the external force required for separating the clamping block from the groove 123 of the anti-forward rotation clamping part 122 can be less than the external force required for separating the clamping block from the groove 123 of the anti-reverse rotation clamping part 121, so that the user experience is improved.

In the second embodiment, the height of an axis of the clamping block along the direction from the rotary knob 10 to the pawl disc 20 is less than the height of the limiting block along the height of the axis, which can ensure that the rotary knob 10 and the pawl disc 20 are still kept connected and restricted at relative positions when the clamping block is meshed and switched with the different grooves 123, thus preventing over rotation of the rotary knob.

Installation and use procedures of the cord tightening and loosening device 1 are described below according to the first and second embodiments.

Firstly, during installation, the pawl disc 20 can be installed on the base 30 to ensure that the first check tooth 232 of the first check member 23 and the second check member 32 are correctly meshed, then the rotary knob 10 is meshed with the second clamping part 122 according to the anti-forward rotation clamping arrangement, and then the rotary knob 10 reversely rotates to the tightening state. Then, the base 30 is installed, and the reel 40 is pressed from the bottom. Then, the rotary knob 10 rotates forward for about one turn, thus the assembly of a main structure of the cord tightening and loosening device 1 is completed, and finally the chassis 50 is installed, wherein the chassis 50 can be arranged on an object body (such as a shoe) with a cord. One end of the cord can pass through the first cord inlet hole 34 of the base 30 and the second cord inlet hole 45 of the reel 40, and the knot can be accomodated in the reel through knotting. It can be understood that after installation, the cord tightening and loosening device 1 can be in the loosening state.

When a user uses the cord tightening and loosening device 1 and the cord needs to be tightened, the rotary knob 10 can rotate in the first clock direction, the rotary knob 10 can drive the pawl disc 20 to rotate, and then the pawl disc 20 can drive the reel 40 to rotate. The cord tightening and loosening device 1 can be in the tightening state, and the cord can be wound around the winding part 43 to tighten the cord. Moreover, due to the cooperation between the first check member 23 and the second check member 32, the pawl disc 20 cannot automatically rotate in the reverse direction, the reel 40 also cannot automatically rotate in the reverse direction, and then the cord can be wound on the reel 40 to tighten the cord. When the rotation of the rotary knob 10 is stopped, the anti-reverse rotation clamping part 121 is clamped with the second clamping part 22, and the rotary knob 10 also cannot automatically rotate backward or forward even when sufficient reverse rotation force is not applied to the rotary knob 10.

When a certain amount of external force is applied to reversely rotate the rotary knob 10, the anti-reverse rotation clamping part 121 is separated from the second clamping part 22, and the rotary knob 10 can rotate reversely. When the rotary knob 10 rotates reversely, the inner side surface 161 of the driving member 15 presses back the outer side surface of the connecting part of the pawl disc 20, the second meshing part 46 is forced to move inward and be separated from the first meshing part 24, so that the cord tightening and loosening device can be in the loosening state. Therefore, the reel 40 can rotate freely in the base 30, and the cord can be loosened, that is, the cord can be pulled out from the reel 40 at this time. Moreover, when the second meshing part 46 moves inward to be separated from the first meshing part 24, the second clamping part 22 of the pawl disc 20 can be just clamped with the anti-forward rotation clamping part 122, and the first limiting part 171 and the second limiting part 212 abut against each other to prevent the rotary knob 10 from rotating reversely excessively. The anti-forward rotation clamping part 122 is clamped with the second clamping part 22, so that the rotary knob 10 can be prevented from automatically rotating forwards to loosen the second clamping part 22 under the condition of no external force, the meshing of the pawl disc 20 and the reel 40 is ensured, and the cord cannot be pulled out freely. It can be understood that the top block 16 can abut between the inner side of the first check member 23 and the winding part 43 in the loosening state to prevent the first check member 23 from being separated from the second check member 32, thus ensuring that the pawl disc 20 is meshed with the base 30, but separated from the reel 40, which means that the pawl disc 20 cannot rotate together with the rotary knob 10. However, the rotary knob 10 can continue to rotate in the first clock direction under certain external force. When the top block 16 rotates with the rotary knob 10 at a certain angle (for example, the second clamping part 22 is separated from the anti-forward rotation clamping part 122 and meshed with the anti-reverse rotation clamping part 121), the top block 16 can be dislocated and separated from the second check member 32, and then the first check member 23 can rotate relative to the second check member 32. At this time, the cord tightening and loosening device 1 can enter the tightening state, that is, the rotary knob 10 can drive the pawl disc 20 and the reel 40 to rotate forward so as to realize storage of the cord.

Further, as shown in FIG. 17, FIG. 18, FIG. 19 and FIG. 20, a third embodiment of the present disclosure provides a cord tightening and loosening device 1. The cord tightening and loosening device 1 in the third embodiment is basically the same as the cord tightening and loosening device 1 in the first embodiment, and the difference between the two cord tightening and loosening devices 1 is mainly described below. In the third embodiment, the driving member 15 may include a driving main body part 151 and a stop part 152 connected to the driving main body part 151, and a side surface of the driving main body part 151 is used for abutting against an outer circumferential surface of the top block 16 to drive the connecting part 25. The stop part 152 is connected with one end of the driving main body part 151 and bent toward the center of the rotary knob 10. The angle between the stop part 152 and the driving main body part 151 can be an obtuse angle. The stop part 152 is used for stopping the connecting part 25 after the connecting part 25 is driven so as to avoid the phenomenon that the first meshing part 24 slides to the outer side of the driving part 15, thus causing the phenomenon that the loosening state cannot be realized. The connecting part 25 also includes an extended block 252 connected with the cylinder 251, and the extended block 252 is used for abutting against the top block 16 in the loosening state.

In the third embodiment, a top surface of the side wall structure 31 of the base 30 is also provided with a plurality of counterpoint installation points 301. The counterpoint installation points 301 are used for assisting the installation of the pawl disc 20. Specifically, the number of the counterpoint installation points 301 can be consistent with the number of the first check members 23, and the positions of counterpoint installation points 301 and the first check members 23 correspond to each other so as to facilitate the installation of the pawl disc 20 with the base 30.

Further, it can be understood that as shown in FIG. 19, the angle on the inner side of the hook 221 is an acute angle for increasing the fastening strength of the hook 221.

Further, as shown in FIG. 21, FIG. 22, FIG. 23 and FIG. 24, a fourth embodiment of the present disclosure provides a cord tightening and loosening device 1. The cord tightening and loosening device 1 in the fourth embodiment is basically the same as the cord tightening and loosening device 1 in the first embodiment, and the difference between the two cord tightening and loosening devices 1 is mainly described below. In the fourth embodiment, the driving member 15 may include a driving main body part 151 and a stop part 152 connected to the driving main body part 151, and a side surface of the driving main body part 151 is used for abutting against an outer circumferential surface of the top block 16 to drive the connecting part 25. The stop part 152 is connected with one end of the driving main body part 151 and bent toward the center of the rotary knob 10. The angle between the stop part 152 and the driving main body part 151 can be an obtuse angle. The stop part 152 is used for stopping the connecting part 25 after the connecting part 25 is driven so as to avoid the phenomenon that the first meshing part 24 slides to the outer side of the driving part 15, thus causing the phenomenon that the loosening state cannot be realized. The connecting part 25 also includes an extended block 252 connected with the cylinder 251, and the extended block 252 is used for abutting against the top block 16 in the loosening state.

In the fourth embodiment, a top surface of the side wall structure 31 of the base 30 is also provided with a plurality of counterpoint installation points. The counterpoint installation points are used for assisting the installation of the pawl disc 20. Specifically, the number of the counterpoint installation points can be consistent with the number of the first check members 23, and the positions of counterpoint installation points and the first check members 23 correspond to each other so as to facilitate the installation of the pawl disc 20 with the base 30.

Further, referring to FIG. 25, an embodiment of the present disclosure also provides a shoe 6. The shoe 6 includes a shoe body 61, a shoelace 62 and the cord tightening and loosening device 1 in any of the above embodiments. The shoelace 62 serves as a cord. The cord tightening and loosening device 1 is used for tightening and loosening the shoelace 62. Wherein, the chassis 50 of the cord tightening and loosening device 1 can be fixed to the shoe body 61.

In the embodiment, the shoelace 62 is tightened and loosened by using the cord tightening and loosening device 1 in any of the above embodiments, and the operation is simple, so that the number of whole components of the cord tightening and loosening device 1 is small, thus reducing the assembly cost and improving the assembly efficiency. The whole structure is compact, thus facilitating the miniaturization and lightweight of the cord tightening and loosening device 1. Moreover, the small number of the components can also improve the stability of the whole structure, so that the reliability of the cord tightening and loosening device 1 is improved, and the service life of the cord tightening and loosening device 1 is prolonged.

Referring to FIG. 26, an embodiment of the present disclosure also provides a cap 7. The cap 7 includes a cap body 71, a cap cord 72 and the cord tightening and loosening device 1 in any of the above embodiments. The cap cord 72 is used for tightening or loosening the cap body 71. The cap cord 72 serves as a cord. The cord tightening and loosening device 1 is used for tightening and loosening the cap cord 72. Wherein, the chassis 50 of the cord tightening and loosening device 1 can be fixed to the cap body 71.

In the embodiment, the cap cord 72 is tightened and loosened by using the cord tightening and loosening device 1 in any of the above embodiments, and the operation is simple, so that the number of whole components of the cord tightening and loosening device 1 is small, thus reducing the assembly cost and improving the assembly efficiency. The whole structure is compact, thus facilitating the miniaturization and lightweight of the cord tightening and loosening device 1. Moreover, the small number of the components can also improve the stability of the whole structure, so that the reliability of the cord tightening and loosening device 1 is improved, and the service life of the cord tightening and loosening device 1 is prolonged.

Referring to FIG. 27, an embodiment of the present disclosure also provides a glove 8. The glove 8 includes a glove body 81, a glove cord 82 and the cord tightening and loosening device 1 in any of the above embodiments. The glove cord 82 is used for tightening or loosening the glove body 81. The glove cord 82 serves as a cord. The cord tightening and loosening device 1 is used for tightening and loosening the glove cord 82. Wherein, the chassis 50 of the cord tightening and loosening device 1 can be fixed to the glove body 81.

In the embodiment, the glove cord 82 is tightened and loosened by using the cord tightening and loosening device 1 in any of the above embodiments, and the operation is simple, so that the number of whole components of the cord tightening and loosening device 1 is small, thus reducing the cost and improving the assembly efficiency. The whole structure is compact, thus facilitating the miniaturization and lightweight of the cord tightening and loosening device 1. Moreover, the small number of the components can also improve the stability of the whole structure, so that the reliability of the cord tightening and loosening device 1 is improved, and the service life of the cord tightening and loosening device 1 is prolonged.

Referring to FIG. 28, an embodiment of the present disclosure also provides a medical protective equipment 100. The medical protective equipment 100 includes a medical protective equipment body 101, a medical protective equipment cord 102, and the cord tightening and loosening device 103 in any of the above embodiments. The medical protective equipment cord 102 is used for tightening or loosening an opening of the medical protective equipment body 101. The medical protective equipment cord 102 serves as the cord. The cord tightening and loosening device 103 is used for tightening and loosening the medical protective equipment cord. It is understood that the medical protective equipment 100 may be arm protective equipment (such as an oversleeve), leg protective equipment (such as knee protective equipment and wrist protective equipment), waist protective equipment, neck protective equipment and other protective equipment, and is not limited to the above embodiments.

Referring to FIG. 29, an embodiment of the present disclosure also provides a storage device 9. The storage device 9 may be a backpack but not limited to a backpack. The storage device 9 includes a storage body 91, a storage cord 92 and the cord tightening and loosening device 1 in any of the above embodiments. The storage cord 92 is used for tightening or loosening the storage body 91. The storage cord 92 serves as a cord. The cord tightening and loosening device 1 is used for tightening and loosening the storage cord 92. Wherein, the chassis 50 of the cord tightening and loosening device 1 can be fixed to the storage body 91.

In the embodiment, the storage cord 92 is tightened and loosened by using the cord tightening and loosening device 1 in any of the above embodiments, and the operation is simple, so that the number of whole components of the cord tightening and loosening device 1 is small, thus reducing the assembly cost and improving the assembly efficiency. The whole structure is compact, thus facilitating the miniaturization and lightweight of the cord tightening and loosening device 1. Moreover, the small number of the components can also improve the stability of the whole structure, so that the reliability of the cord tightening and loosening device 1 is improved, and the service life of the cord tightening and loosening device 1 is prolonged.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A cord tightening and loosening device, comprising:

a rotary knob, comprising a cover plate, a first clamping part formed on one side of the cover plate, a driving member formed on one side of the cover plate, a side plate connected to one side of the cover plate, and a first limiting member connected to the end, away from the cover plate, of the side plate;

a pawl disc, comprising a base plate, a second clamping part formed on the side, adjacent to the first clamping part, of the base plate and used for being clamped with the first clamping part, a first check member formed on an outer edge of the base plate, a first meshing part formed between the base plate and the first check member, and a connecting part connected to the first meshing part;

a base, comprising a side wall structure annularly arranged on the circumference of the pawl disc, a second check member formed on an inner surface of the side wall structure, and a second limiting member formed on the side wall structure; the side wall structure accommodates the pawl disc, a first cord inlet hole is also formed in the side wall structure in a penetrating manner, and the second check member is meshed with the first check member, so that the pawl disc can rotate relative to the base along a predetermined clock direction; the second limiting member extends into a storage space surrounded by the cover plate and the side plate, and can be limited in the storage space by the first limiting member; the rotary knob can drive the pawl disc to rotate;

a reel, located in the side wall structure and arranged on the side, away from the rotary knob, the pawl disc, and comprising two opposite base plate parts, a winding part connected between the two base plate parts, an extended wall connected to the base plate close to the pawl disc, and a second meshing part arranged on the inner side of the extended wall and used for being matched with the first meshing part; the winding part comprises a second cord inlet hole, so that a cord can pass through the first cord inlet hole and the second cord inlet hole and is arranged on the reel;

a chassis, located on the side, away from the rotary knob, of the base and fixed with the base;

wherein, when the first meshing part is meshed with the second meshing part and the rotary knob rotates in a first clock direction, the rotary knob can drive the pawl disc to rotate, and then the pawl disc drives the reel to rotate, so that the cord tightening and loosening device can be in a tightening state and the cord can be wound around the winding part to tighten the cord;

when the rotary knob rotates in a second clock direction opposite to the first clock direction, the driving member drives the connecting part, the first meshing part is separated from the second meshing part, the cord tightening and loosening device is in a loosening state, and then the reel can rotate to realize the release of the cord.

2. The cord tightening and loosening device according to claim 1, wherein the rotary knob also comprises a top block arranged on one side of the cover plate, and the top block is used for abutting between the inner side of the first check member and the winding part in the loosening state to prevent the first check member from being separated from the second check member.

3. The cord tightening and loosening device according to claim 2, wherein the top block comprises an inner side surface and an outer side surface, and the distance between the inner side surface and the outer side surface is gradually decreased along the first clock direction; the connecting part comprises a cylinder, and a side surface of the driving member is used for abutting against an outer circumferential surface of the cylinder to drive the connecting part.

4. The cord tightening and loosening device according to claim 3, wherein the connecting part also comprises an extended block connected with the cylinder, and the extended block is used for abutting against the top block in the loosening state; the driving member comprises a driving main body part and a stop part connected to the driving main body part, and a side surface of the driving main body part is used for abutting against an outer circumferential surface of the top block to drive the connecting part; the stop part is bent and connected with the driving main body part, and is used for stopping the top block after the connecting part is driven, so as to prevent the first meshing part from sliding out to the outer side of the driving part.

5. The cord tightening and loosening device according to claim 2, wherein the first clamping part comprises an anti-forward rotation clamping part and an anti-reverse rotation clamping part; when the cord tightening and loosening device is in the tightening state, the anti-reverse rotation clamping part is clamped with the second clamping part; and when the cord tightening and loosening device is in the loosening state, the anti-forward rotation clamping part is clamped with the second clamping part.

6. The cord tightening and loosening device according to claim 5, wherein the number of the second clamping parts is at least two, the second clamping parts are distributed in turn along the circumferential direction, the numbers of the anti-forward rotation clamping parts and the anti-reverse rotation clamping parts are both at least two, and the anti-forward rotation clamping parts and the anti-reverse rotation clamping parts are distributed in turn along the circumferential direction; the numbers of the first clamping parts and the connecting parts are both at least two, and the first clamping parts and the connecting parts are distributed in turn along the circumferential direction; the numbers of the first check members and the second check members are at least two, and the first check members and the second check members are distributed in turn along the circumferential direction; the numbers of the driving members and the top blocks are consistent with and corresponding to the number of the connecting parts; the first check member comprises an elastic arm and a first check tooth connected with the elastic arm, and the second check member comprises a plurality of second check teeth connected in turn along the circumferential direction; the first meshing part comprises a connecting arm and a first meshing tooth connected to the connecting arm, and the second meshing part comprises a plurality of second meshing teeth connected in turn along the circumferential direction.

7. The cord tightening and loosening device according to claim 5, wherein the rotary knob comprises a raised structure arranged in a middle area of the cover plate, the anti-forward rotation clamping part and the anti-reverse rotation clamping part are grooves formed in an outer side surface of the raised structure in turn, the base plate comprises a groove structure formed in a middle area, the second clamping part comprises a hook extending into the groove structure, and the hook is used for being clamped with the groove of the anti-forward rotation clamping part or the groove of the anti-reverse rotation clamping part.

8. The cord tightening and loosening device according to claim 7, wherein the outer side surface of the raised structure is also provided with a first limiting part, a side wall surface of the groove structure is also provided with a second limiting part, one of the first limiting part and the second limiting part is a limiting block, the other of the first limiting part and the second limiting part is a limiting chute, and the limiting block is used for sliding in the limiting chute to limit a relative rotation angle of the rotary knob and the pawl disc, so that the anti-forward rotation clamping part and the anti-reverse rotation clamping part of the rotary knob are meshed with or separated from the second clamping part of the pawl disc in turn; the groove comprises a first surface and a second surface which are bent and connected, the raised structure is provided with an arc surface connected to the first surface and the second surface, the angle between the first surface and the tangent line of a connection point of the arc surface of the part where the first surface is connected and is different from the angle between the second surface and the tangent line of a connection point of the arc surface of the part where the second surface is connected, so that the external force required for separating the hook from the groove of the anti-forward rotation clamping part is less than the external force required for separating the hook from the groove of the anti-reverse rotation clamping part.

9. The cord tightening and loosening device according to claim 5, wherein the anti-forward rotation clamping part and the anti-reverse rotation clamping part are grooves formed in the cover plate in turn along the circumferential direction, the second clamping part is a clamping block arranged on the winding part, and the clamping block is used for being clamped with the groove of the anti-forward rotation clamping part or the groove of the anti-reverse rotation clamping part.

10. The cord tightening and loosening device according to claim 9, wherein one side of the cover plate is also provided with a first limiting part, the side, close to the cover plate, of the winding part is also provided with a second limiting part, one of the first limiting part and the second limiting part is a limiting block, the other of the first limiting part and the second limiting part is a limiting chute, and the limiting block is used for sliding in the limiting chute to limit a relative rotation angle between the rotary knob and the pawl disc, so that the anti-forward rotation clamping part and the anti-reverse rotation clamping part of the rotary knob are meshed with or separated from the second clamping part of the pawl disc in turn; the numbers of the first limiting parts and the second limiting parts are at least two, the first limiting parts and the second limiting parts are distributed along the circumferential direction, and the height of an axis of the clamping block along the direction from the rotary knob to the pawl disc is less than the height of the limiting block along the height of the axis; the groove comprises a first surface and a second surface which are bent and connected, and the angle between a body surface on one side of the cover plate and the first surface is different from the angle between the body surface on one side of the cover plate and the second surface, so that the external force required for separating the clamping block from the groove of the anti-forward rotation clamping part is less than the external force required for separating the clamping block from the groove of the anti-reverse rotation clamping part.

11. The cord tightening and loosening device according to claim 1, wherein the base plate part away from the pawl disc also comprises at least one slot communicating with the second cord inlet hole, and the slot is used for accommodating a knot for limiting the cord.

12. A shoe, comprising a shoe body, a shoelace, and the cord tightening and loosening device according to claim 1, wherein the shoelace serves as the cord, and the cord tightening and loosening device is used for tightening and loosening the shoelace.

13. A glove, comprising a glove body, a glove cord, and the cord tightening and loosening device according to claim 1, wherein the glove cord is used for tightening or loosening the glove body, the glove cord serves as the cord, and the cord tightening and loosening device is used for tightening and loosening the glove cord.

14. A medical protective equipment, comprising a medical protective equipment body, a medical protective equipment cord, and the cord tightening and loosening device according to claim 1, wherein the medical protective equipment cord is used for tightening or loosening an opening of the medical protective equipment body, the medical protective equipment cord serves as the cord, and the cord tightening and loosening device is used for tightening and loosening the medical protective equipment cord.

15. A storage device, comprising a storage body in which an opening is formed, a storage cord, and the cord tightening and loosening device according to claim 1, wherein the storage cord is used for tightening or loosening the opening, the storage cord serves as the cord, and the cord tightening and loosening device is used for tightening and loosening the storage cord.

* * * * *